US007935027B2

(12) United States Patent
Graber

(10) Patent No.: US 7,935,027 B2
(45) Date of Patent: May 3, 2011

(54) SPONTANEOUS SYMMETRICAL WEIGHT SHIFTING TRAINER DEVICE

(75) Inventor: Jase Graber, Menomonie, WI (US)

(73) Assignee: The Shifter, Inc, Minneapolis, MN (US)

( * ) Notice: Subject to any disclaimer, the term of this patent is extended or adjusted under 35 U.S.C. 154(b) by 1268 days.

(21) Appl. No.: 11/447,688

(22) Filed: Jun. 6, 2006

(65) Prior Publication Data

US 2006/0293154 A1 Dec. 28, 2006

Related U.S. Application Data

(63) Continuation-in-part of application No. 10/833,529, filed on Apr. 28, 2004, which is a continuation-in-part of application No. 10/637,972, filed on Aug. 11, 2003, now Pat. No. 7,033,306.

(60) Provisional application No. 60/789,675, filed on Apr. 4, 2006, provisional application No. 60/418,394, filed on Oct. 9, 2002.

(51) Int. Cl.
*A63B 22/00* (2006.01)

(52) U.S. Cl. ..... 482/51; 482/52

(58) Field of Classification Search ..... 482/15, 482/51, 52, 53, 56, 57, 70, 71, 79, 80, 142, 482/148; 434/247, 248, 251, 255; 74/572.1, 74/572.2

See application file for complete search history.

(56) References Cited

U.S. PATENT DOCUMENTS

| | | | | |
|---|---|---|---|---|
| 4,185,622 | A | 1/1980 | Swenson | 601/27 |
| 5,199,931 | A | 4/1993 | Easley et al. | 482/52 |
| 5,242,343 | A * | 9/1993 | Miller | 482/57 |
| 5,247,853 | A * | 9/1993 | Dalebout | 74/574.2 |
| 5,259,269 | A * | 11/1993 | Swenson, Sr. | 74/571.11 |
| 5,338,273 | A | 8/1994 | Metcalf et al. | 482/70 |
| 5,423,729 | A | 6/1995 | Eschenbach | 482/70 |
| 5,529,555 | A | 6/1996 | Rodgers, Jr. | 482/57 |
| 5,833,583 | A | 11/1998 | Chuang | 482/60 |
| 5,895,339 | A | 4/1999 | Maresh | 482/51 |
| 5,947,874 | A | 9/1999 | Dougherty | 482/62 |
| 6,030,320 | A | 2/2000 | Stearns et al. | 482/57 |
| 6,080,086 | A | 6/2000 | Maresh et al. | 482/57 |
| 6,123,650 | A | 9/2000 | Birrell | 482/70 |
| 6,165,107 | A | 12/2000 | Birrell | 482/70 |
| 6,234,939 | B1 * | 5/2001 | Moser et al. | 482/63 |
| 6,248,046 | B1 | 6/2001 | Maresh et al. | 482/57 |
| 6,277,055 | B1 | 8/2001 | Birrell et al. | 482/52 |
| 6,340,340 | B1 | 1/2002 | Stearns et al. | 482/52 |

(Continued)

*Primary Examiner* — Loan Thanh
*Assistant Examiner* — Tam Nguyen
(74) *Attorney, Agent, or Firm* — Mark A. Litman & Associates, P.A.

(57) ABSTRACT

A method of improving mobility skills of a user on a stationary elliptical exercise device comprising two footpads, each footpad associated with a stationary exercise device, comprising a frame member having a transverse pivot axis. A first and a second foot tread member are operatively associated with a coupling member for pivotally coupling the front end of each foot tread member to the pivot axis at a predetermined distance from the pivot axis, so that each foot tread member front end travels in an arcuate path about the pivot axis. Each foot tread member moves independently of the other foot tread member. Each foot tread member rear end is operatively associated with a glide member for moveable coupling of the rear end of each foot tread member to a support surface. The glide members direct each foot tread member rear end along a reciprocating path of travel, as each foot tread member front end travels in an arcuate path.

9 Claims, 12 Drawing Sheets

U.S. PATENT DOCUMENTS 6,416,442 B1 7/2002 Stearns et al. ..... 482/52
6,551,218 B2 4/2003 Goh ..... 482/52
2002/0107114 A1* 8/2002 Byrd, Jr. ..... 482/57
2006/0094569 A1* 5/2006 Day ..... 482/57

* cited by examiner

SPONTANEOUS SYMMETRICAL WEIGHT SHIFTING TRAINER DEVICE

CROSS-REFERENCE TO RELATED APPLICATIONS

This application is a continuation-in-part of U.S. Patent Application Ser. No. 60/789,675 filed Apr. 4, 2006, which is a continuation-in-part of co-pending utility application Ser. No. 10/833,529, filed 28 Apr. 2004, which is a continuation-in-part of utility application Ser. No. 10/637,972, filed 11 Aug. 2003 now U.S. Pat. No. 7,033,306, which claims the benefit under 35 U.S.C. §119 (e) of provisional application Ser. No. 60/418,394, filed 9 Oct. 2002. Application Ser. Nos. 10/637,972 and 60/418,394 are hereby incorporated by reference.

BACKGROUND OF THE INVENTION

1. Field of the Invention

The present invention relates to a device for performing an exercise and, more particularly, to a training device for improving a person's ability to shift their weight from one foot to the other, especially where the training is to assist in spontaneous weight transfer. Also disclosed is a method for operating the exercise device. The present invention also relates to the field of specialty training exercises for maximizing athletic and health preserving physical skills.

2. Background of the Art

Many exercise devices are presently available for a wide variety of exercise and conditioning movements for individuals. An exercise device to assist in training an individual to spontaneously shift weight from one foot to the other is not available. To address this need, the present invention was developed. The device of the present invention improves balance and coordination and provides improved cardiovascular health.

A number of patents concerned with various exercise devices have been granted. These patents include the following:

In U.S. Pat. No. 4,185,622, Swenson discloses a foot and leg exerciser with an inclinable base, at least one foot pad for supporting and moving the foot of the user, and means for moving the foot pads in a pattern to provide mild exercise which simulates normal walking. The heel ends of the foot pads are moved in a vertical plane by revolving cranks driven by an electric motor through reduction gears, while the toe ends of the foot pads are supported on adjustable rocker arms. Starting, stopping and speed of the motor are controllable by the user through a remote control box.

Easley et al., in U.S. Pat. No. 5,199,931, describe an improved exercise machine for simulating stair climbing, and is particularly adapted for in-home use. The device includes a generally upright frame with a base. Right and left foot pedals are pivotally mounted to the base on both sides of the upstanding portion of the frame, respectively, and a handlebar is provided adjacent to the upper end of the frame. The foot pedals are linked to a mechanical resistance element, namely a flywheel. The linkage includes a strap connecting each pedal to a single drive shaft, in turn connected by a belt transmission to the flywheel. A resistance adjustment feature is included in the invention.

In U.S. Pat. No. 5,242,343, Miller discloses an exercise device that includes a pair of foot engaging links. The first end of each link is supported for rotational motion about a pivot axis and a second end of each foot link is guided in a reciprocal path of travel. The combination of these foot link motions permits the user's foot to move in an inclined, oval path of travel. This natural foot action exercises a large number of muscles through a wide range of motion. Only a single fly wheel is connected to both foot pads.

Metcalf et al., in U.S. Pat. No. 5,338,273, describe a synchronous/asynchronous exercise machine that is changeable between a synchronous exercise mode wherein a user's limbs, such as his legs, oppositely reciprocate, and an asynchronous exercise mode wherein the user's limbs move independently. The synchronous/asynchronous exercise machine comprises a first movable element for accepting a user's limb, and a second movable element for accepting another limb. A load source against which the user can exercise may also be provided. A first drive belt operatively connects the first movable element to the load source, and a second drive belt operatively connects the second movable element to the load source. A quick change mechanism, which may be connected to the first movable element, is releasably engagable with the second drive belt for changing the synchronous/asynchronous exercise machine between the synchronous exercise mode and the asynchronous exercise mode.

In U.S. Pat. No. 5,423,729, Eschenback discloses an exercise apparatus having a collapsible frame that simulates running and climbing, depending upon where the foot is positioned along the elongated pedal. The user is able to maintain a standing posture while elongated pedals supporting each foot moves through an exercise cycle having a different mode for each foot position that includes translating and nonparallel angular motion generated by a linkage mechanism. Arm exercise is provided by rocker extensions which are phased with the crank to use arm force for moving the crank through dead center positions.

Rogers, Jr., in U.S. Pat. No. 5,529,555, describes a crank assembly for use within an exercising device which promotes cardiovascular exercise yet minimizes impact on critical joints, particularly the ankles and knees. The crank assembly employs a dual coupler system which is interconnected for synchronized rotation. Linkage assemblies are provided which define a predetermined path having a preferred anatomical pattern for foot movement of the user. The crank assembly can be used in an exercising device which promotes leg exercise primarily, or can be combined with two additional linkage assemblies to provide a combined hand motion with leg movement. In this manner, an enhanced cardiovascular workout is provided which minimizes stress on key joints, particularly the ankles and knees.

In U.S. Pat. No. 5,833,583, Chuang discloses an exerciser having a base, two gears secured on the base, and two plates rotatably secured to the base at an axle. Two pinions are rotatably secured to the plates and engaged with the gears. Two foot supports are slidably secured to and movable radially relative to the plates and each foot support has a foot pedal and each has one end secured to the pinions at an eccentric shaft, for allowing the foot pedals to be moved toward and away from the axle and for allowing the foot pedals to be moved along an elliptic moving path when the foot supports are moved radially relative to the plates.

Maresh, in U.S. Pat. No. 5,895,339, discloses an exercise apparatus having a linkage assembly which links rotation of a crank to generally elliptical movement of a foot supporting member. The linkage assembly includes a first link having a first end rotatably connected to a first rocker link, an intermediate portion rotatably connected to the crank, and a second end rotatably connected to a rearward end of the foot supporting member. An opposite, forward end of the foot supporting member is rotatably connected to a second rocker link. An upper distal portion of the second rocker link is sized and configured for grasping by a person standing on the foot supporting member.

U.S. Pat. No. 5,947,874, by Dougherty, discloses an exercise device for simulating elliptical motion of stair climbing, including a frame having a front support and a rear support, and with upper and lower exercise units. The front support and rear support meet at an apex where they form an acute angle. The exercise units each include a pair of elliptical guide tracks which each form a closed loop. A pair of actuating levers is each attached onto the guide tracks by a partial sleeve which is capable of travel around the loop. Each exercise unit also includes a flywheel assembly which has two pairs of flywheels mounted to the rear support. Each flywheel is attached to one of the actuating levers by a connecting lever. The flywheels are shaped and the connecting levers are connected to the flywheels so as to permit elliptical motion of the actuating levers around the guide track.

Sterns et al., in U.S. Pat. No. 6,030,320, describe an exercise apparatus having a linkage assembly which links rotation of a crank to the generally elliptical movement of a force receiving member. The apparatus may be folded into a storage configuration having an overall height which is less than the greater of the diameter of the crank and the diameter of a flywheel which rotates together with the crank.

In U.S. Pat. No. 6,080,086, Maresh et al. disclose an exercise apparatus that links rotation of a crank to the generally elliptical motion of a foot supporting member. In particular, both a foot supporting linkage and a draw bar linkage are movably connected between a rocker link and the crank in such a manner that the foot supporting member is constrained to move through an elliptical path of motion. The configuration of the elliptical path may be selectively altered by adjusting the draw bar linkage relative to the rocker link.

Birrell, in U.S. Pat. No. 6,123,650, describes an exerciser including a floor engaging frame and a forward upright post structure. Toward the rear of the frame are attached left and right axle mount supports, which house a transverse axle. The axle is bifurcated allowing the two halves to rotate independently of one another and connect to left and right drive wheels, respectively. Left and right foot link members rollably engage the drive wheels at the link member's rear end portions. The forward end portions of the foot link members rollably engage left and right inclinable guide ramps. The inclinable guide ramps are biased rotationally upwardly, to resist downward forces, by biasing members, such as springs. Left and right foot support portions are mounted on the foot link members. As the foot link members reciprocate forwardly and rearwardly along the inclinable guide ramps, the interaction of the oscillating weight of a running or walking user, together with the independently upwardly biased inclinable guide ramps, causes the foot support portions to travel along an elliptical path.

U.S. Pat. No. 6,165,107 by Birrell describes an exerciser that includes a floor engaging frame. Toward the rear of the frame are attached left and right axle mount supports that house a transverse axle. The axle connects the left and right drive wheels. Rear portions of left and right foot link members rollably engage the drive wheels. Front portions of the foot link members rollably engage left and right inclinable guide ramps. The inclinable guide ramps are biased rotationally upwardly by a ramp return assembly that causes one ramp to pivot downwardly as the other ramp pivots upwardly. Forward and rearward pulley and belt systems are connected to the foot links and provide flexibly coordinated motion which substantially relates the movement of the first and second foot links to each other, while permitting some degree of uncoordinated motion between the foot links. When the foot link members reciprocate along the inclinable guide ramps, the interaction between the oscillating weight of a user and the upwardly biased guide ramps causes the foot support portions to travel along elliptical paths.

Maresh et al., in U.S. Pat. No. 6,248,046, describe an exercise apparatus that links rotation of a crank to generally elliptical motion of a foot supporting member. In particular, both a foot supporting linkage and a draw bar linkage are movably connected between a rocker link and the crank in such a manner that the foot supporting member is constrained to move through an elliptical path of motion. The configuration of the elliptical path may be selectively altered by adjusting the draw bar linkage relative to the rocker link.

In U.S. Pat. No. 6,277,055, Birrell et al. disclose a flexibly coordinated stationary exercise device that includes a frame which has a forward upright member. The axle mounts are attached to the rear region of the frame and support a transverse axle which is preferably operatively connected to a flywheel. The ends of the transverse axle rotatably engage left and right crank arm assemblies that are coupled to the left and right foot links, so that the foot links travel in an arcuate reciprocal path as the transverse axle rotates. The foot links are operatively connected to swing arm mechanisms, which in turn are rotatably connected to the forward upright member at separate pivot points. The swing arm mechanisms further contain hand-gripping portions, and the foot links further contain foot support portions. Flexibly coordinating members are incorporated in the linkage between each respective hand-gripping portion and foot support portion to substantially and resiliently link the movement of the foot support portions to the movement of the hand-gripping portions, while permitting some degree of uncoordinated motion between the foot support portions and the hand-gripping portions.

Steams et al., in U.S. Pat. No. 6,340,340, describe an exercise apparatus that includes a crank rotatably mounted on a frame and an axially extending support connected to the crank at a radially displaced location. A foot supporting member is movably interconnected between the axially extending support and the frame. A linkage assembly links rotation of the crank to movement of a foot platform through a generally elliptical path.

U.S. Pat. No. 6,416,442 by Stearns et al. disclose an exercise apparatus having a linkage assembly which links rotation of a crank to generally elliptical movement of a foot supporting member. The crank rotates about a crank axis relative to a frame and a distal portion of a link moves relative to a connection point on the frame. An intermediate portion of the link is rotatably connected to the crank, and an opposite distal portion of the link is rotatably connected to a rearward end of the foot supporting member. An opposite, forward end of the foot supporting member is movably connected to the frame.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

SUMMARY OF THE INVENTION

A stationary exercise device comprises a frame member which has a transverse pivot axis defined relative to the frame member. A first foot tread member and a second foot tread member are present, each foot tread member respectively having a front end, a rear end, and two sides, with each first foot tread member and second foot tread member front end operatively associated with a coupling member or coupler for pivotally coupling the front end of each first and second foot tread member to the transverse pivot axis at a predetermined distance there from, so that each first foot tread member and second foot tread member front end travels in an arcuate path about the transverse pivot axis. Each first foot tread member and second foot tread member moves independently of the other of the first and second foot tread member at both the front end and the rear end. Each first foot tread member and second foot tread member moves along a line between the tread member front end and rear end. Each first and second foot tread member rear end moves in a reciprocating path of travel, as each first and second foot tread member front end travels in an arcuate path. When the exercise device is in use, and when the rear end of each first foot tread member and second foot tread member travels along the reciprocating path of travel in a direction away from the pivot axis, the toe portion of the user's foot associated therewith initially lowers at a rate faster than the heel portion of the user's foot. When the rear end of each first foot tread member and second foot tread member travels along the reciprocating path of travel in a direction toward the pivot axis, the toe portion of the user's foot associated therewith initially rises at a rate faster than the heel portion of the user's foot.

In one embodiment, the stationary exercise device comprises a frame member having a transverse pivot axis defined relative to the frame member. A first foot tread member and a second foot tread member are present, each first and second foot tread member having a front end, a rear end, and two sides. Each first foot tread member and second foot tread member front end is operatively associated with a coupling member for pivotally coupling the front end of each first and second foot tread member to the transverse pivot axis at a predetermined distance from the transverse pivot axis, so that each first and second foot tread member front end travels in an arcuate path about the transverse pivot axis. Each first foot tread member and second foot tread member moves independently of the other of the first foot tread member and second foot tread member, each first and second foot tread member moving along a line between the tread member front end and rear end. Each first and second foot tread member rear end is operatively associated with a glide member for moveable coupling of the rear end of each first and second foot tread member to the frame member. The glide members direct each first and second foot tread member rear end along a reciprocating path of travel, as each first and second foot tread member front end of the same foot tread member travels in an arcuate path. When the exercise device is in use, and when the rear end of each first and second foot tread member travels along the reciprocating path of travel in a direction away from the pivot axis, the toe portion of the user's foot associated therewith initially lowers at a rate faster than the heel portion of the user's foot. When the rear end of each first and second foot tread member travels along the reciprocating path of travel in a direction toward the pivot axis, the toe portion of the user's foot associated therewith initially rises at a rate faster than the heel portion of the user's foot.

The unique independent foot/leg activity of the system of the device of the present invention enables training exercises that can enhance advanced physiological skills and techniques that can enhance abilities, capabilities, skills and responses. The independent functioning of the two footpads and their inertial systems (referred to herein as decoupled footpad systems in that each footpad and each inertial system glides and rotates independent of the other footpad and inertial system) enables general and specific training and skill enhancing exercises and progressions of exercises that provide unique results on the individuals.

DESCRIPTION OF THE EMBODIMENTS

Nomenclature of the Elements in the Figures

10 Exercise Device
15 Frame Member
16 Frame Housings
17 Rigid Connector Member

18 Planar Plate Member
20 Axial Shaft
25 Rotating Wheel Member
30 Bell Crank
35 Bell Crank
40 Foot Tread Member
40*a* Front End of Foot Tread Member
40*b* Rear End of Foot Tread Member
40*c* Sides of Foot Tread Member
41 Foot Pad Portion
45 Foot Tread Member
45*a* Front End of Foot Tread Member
45*b* Rear End of Foot Tread Member
40*c* Sides of Foot Tread Member
46 Foot Pad Portion
48 Glide Members
50 Wheeled Glide Member
55 Wheeled Glide Member
57 Wheels
60 Linear Track Portion
65 Linear Track Portion
70 Friction Brake Member
75 Brake Adjustment Knob
85 User Support Member
90 U-Shaped Portion of Support Member
95 Legs of Support Member
125 Fly Wheel Member
130 Spindle Member
135 Spindle Member
140 Fly Wheel Belt Member
A Transverse Pivot Axis

Examples of Construction

Figure 1:
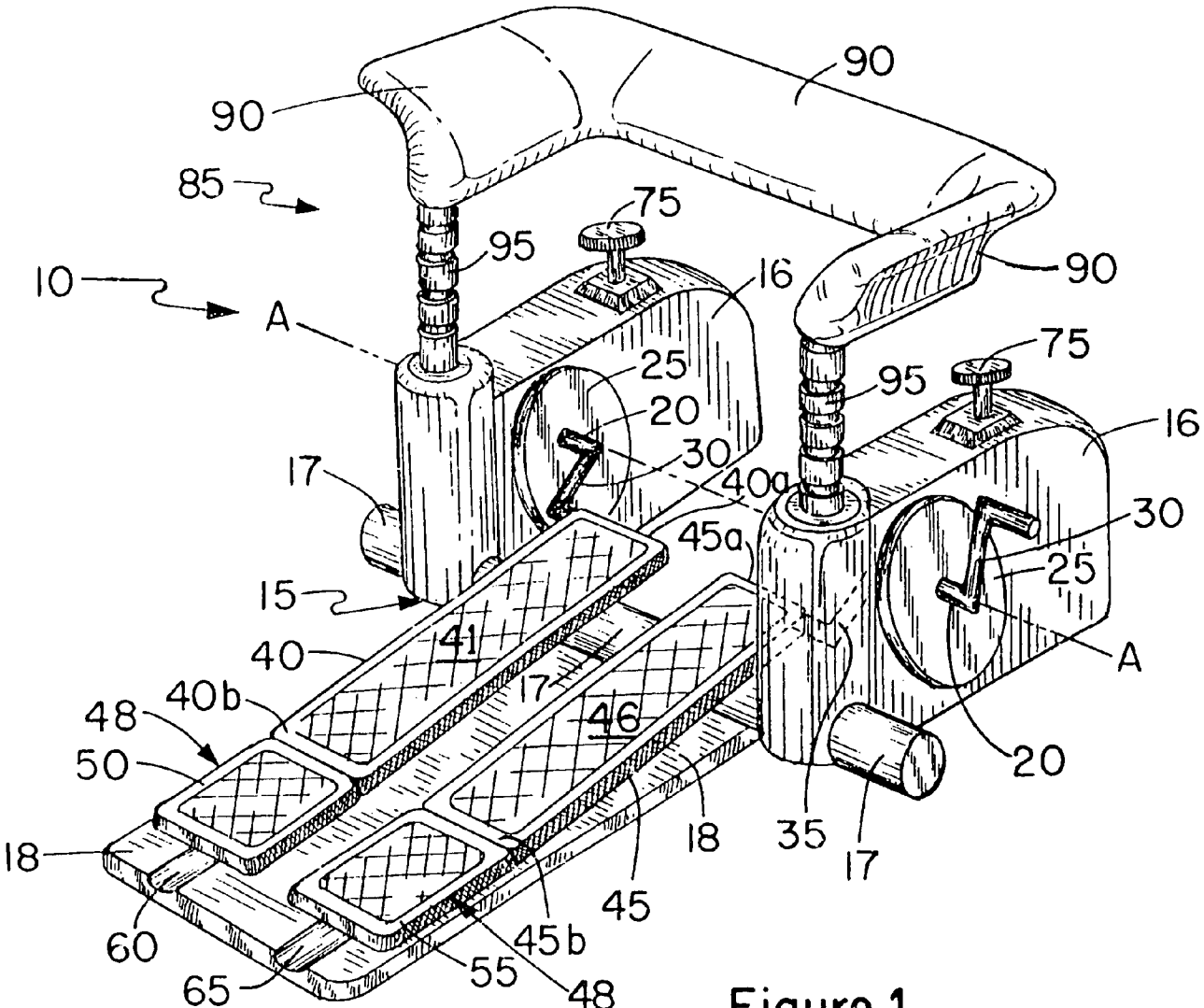
FIG. 1 is a perspective view of one embodiment of the exercise device of present invention.

Referring to the FIG. 1, one non-limiting embodiment of the exercise device 10, is shown as a structure in accord with some principles of the present invention illustrated. The exercise device 10 includes a frame member 15 adapted for being supported on a floor or other such surface. The frame member 15 has a pivot axis, A, defined therein, for example, by one or more shafts 20 passing through and supported by the frame member 15. In the embodiment illustrated in FIG. 1, the shafts 20 each have a rotating wheel member 25 supported thereupon for rotation about the pivot axis A. The frame member 15 includes housings 16 supporting the shafts 20 and rotating wheel members 25, with the housings 16 joined by a rigid connector member 17 for holding the housings 16, shafts 20 and rotating wheel members 25 in a constant orientation. The frame member 15 also includes a planar plate member 18 described below. The exercise device 10 further includes a first and a second bell crank 30, 35, pivotally mounted for rotation about the axis A. The exercise device 10 further includes a first and a second foot tread member, 40, 45, respectively. The second bell crank 35 is shown in phantom in FIG. 1. The foot tread members 40, 45 are generally elongated members having a front end 40*a*, 45*a*, a rear end 40*b*, 45*b*, and two sides 40*c*, 45*c*, respectively. The foot tread member front ends 40*a*, 45*a*, are pivotally connected to the coupling member, (in this instance the bell cranks 30, 35) in such a manner so as to permit travel of the front ends 40*a*, 45*a* of the foot tread members 40 and 45 in an arcuate path of travel about the pivot axis A at a predetermined length corresponding to the length of the bell cranks 30, 35. Within the context of this application, "arcuate" will refer to a circular, oval, elliptical or other such closed, curved path of travel.

A rear end 40*b*, 45*b* of the foot tread members 40 and 45, moves in a reciprocating path of travel as each foot tread member 40, 45 travels in an arcuate path. The rear ends 40*b*, 45*b* of the foot tread members 40, 45 may be suspended by cables, rods, straps, belts or similar suspension means, or may simply ride directly on a suitable support surface associated with the planar plate member 18. Preferably, the rear end 40*b*, 45*b* of the foot tread members 40 and 45, respectively, terminate in glide members 48 that ride on a suitable support surface. Within the context of this application, a "glide member" is defined as an element having a sliding, gliding, rolling or otherwise friction reducing function, yet including a support and guiding function for the foot tread member rear ends 40*b*, 45*b*. In the present embodiment of FIG. 1, the glide members 48 comprises wheeled member 50, 55, best seen in FIGS. 5 and 6. Other embodiments of the glide members 48 secured to the foot tread member rear ends 40*b*, 45*b*, includes Teflon® glides, pin glides, ball glides, belt glides, hydraulic supports and other equivalent elements that provide a function of reducing friction. In the embodiment of FIG. 1, most preferably, the wheeled members 50, 55 engage linear tracks 60, 65. The tracks 60, 65 direct the wheeled members 50, 55 and, consequently, the rear end 40*b*, 45*b* of the foot tread members 40, 45 in a reciprocal path of travel, as the front ends 40*a*, 45*a* of the tread members 40, 45 travel about the transverse pivot axis A. Preferably, the linear tracks 60, 65 are located on the surface of the planar plate member 18 of the frame member 15. Within the context of this application, a "reciprocal" path of travel is meant to define any back and forth path of travel which is repetitively traversed by the rear ends 40*b*, 45*b* of the foot tread members 40, 45, and includes a generally linear path of travel as is provided by the tracks 60, 65 of the FIG. 1 embodiment shown herein. It is important to note that each foot tread member 40, 45 moves independently of each other. The force applied to one foot track member by a user in no way influences the movement of the other foot track member. This configuration allows the foot tread members 40, 45 to move in tandem or in unison. Additionally, the independence of each foot tread member 40, 45 allows each to move in the same direction, i.e., clockwise or counter clockwise, or one to move clockwise and the other to move counter clockwise. This feature of the present invention provides for greater versatility in the number and complexity of exercises and movements available to the user.

Figure 6:
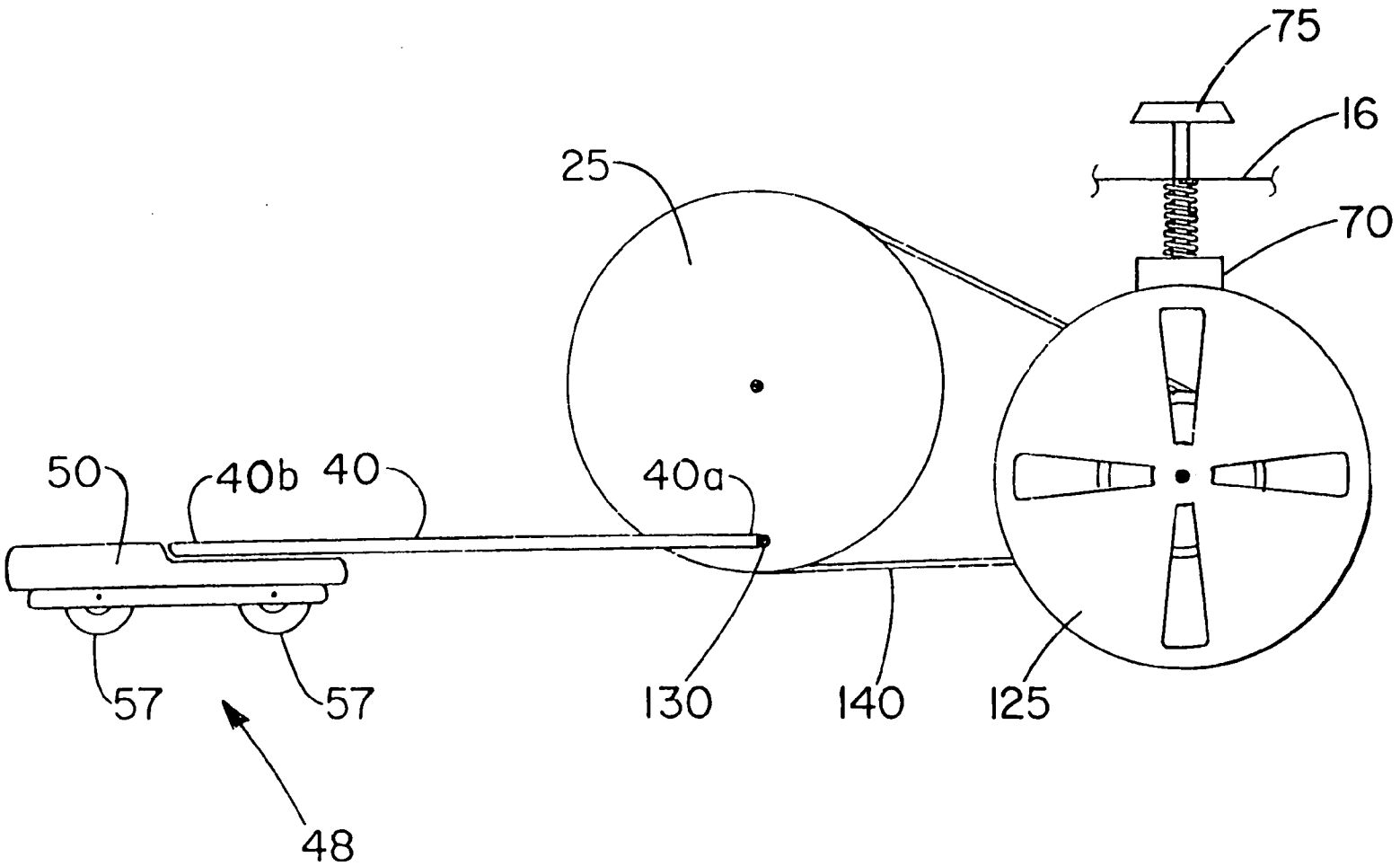
FIG. 6 is a side view of the foot pad member connected to the wheeled glide member and fly wheel mechanism of one embodiment of the exercise device of the present invention.

The apparatus of the FIG. 1 embodiment may further include friction brakes 70 associated with each rotating wheel member 25 for purposes of imposing drag on the wheel 25 so as to increase the amount of exercise provided by the exercise apparatus 10, as illustrated in FIG. 6. The friction brakes 70 are enclosed within the frame housings 16 and may be adjusted by an adjustment knob 75 operating upon the friction pad of the brake assembly, as is well known to those of skill in the art. Other types of braking devices such as a magnetic brake, a hydraulic brake link, or any other physical braking system, may be similarly employed. In the illustrated embodiment, the frame member 15 includes a user support member 85 mounted upright to the frame member 15. Preferably, the user support member 85 includes a U-shaped portion 90 with a pair of vertical legs 95, each leg 95 adjustably secured to one of the two housings 16 of the frame member 15.

Figure 3:
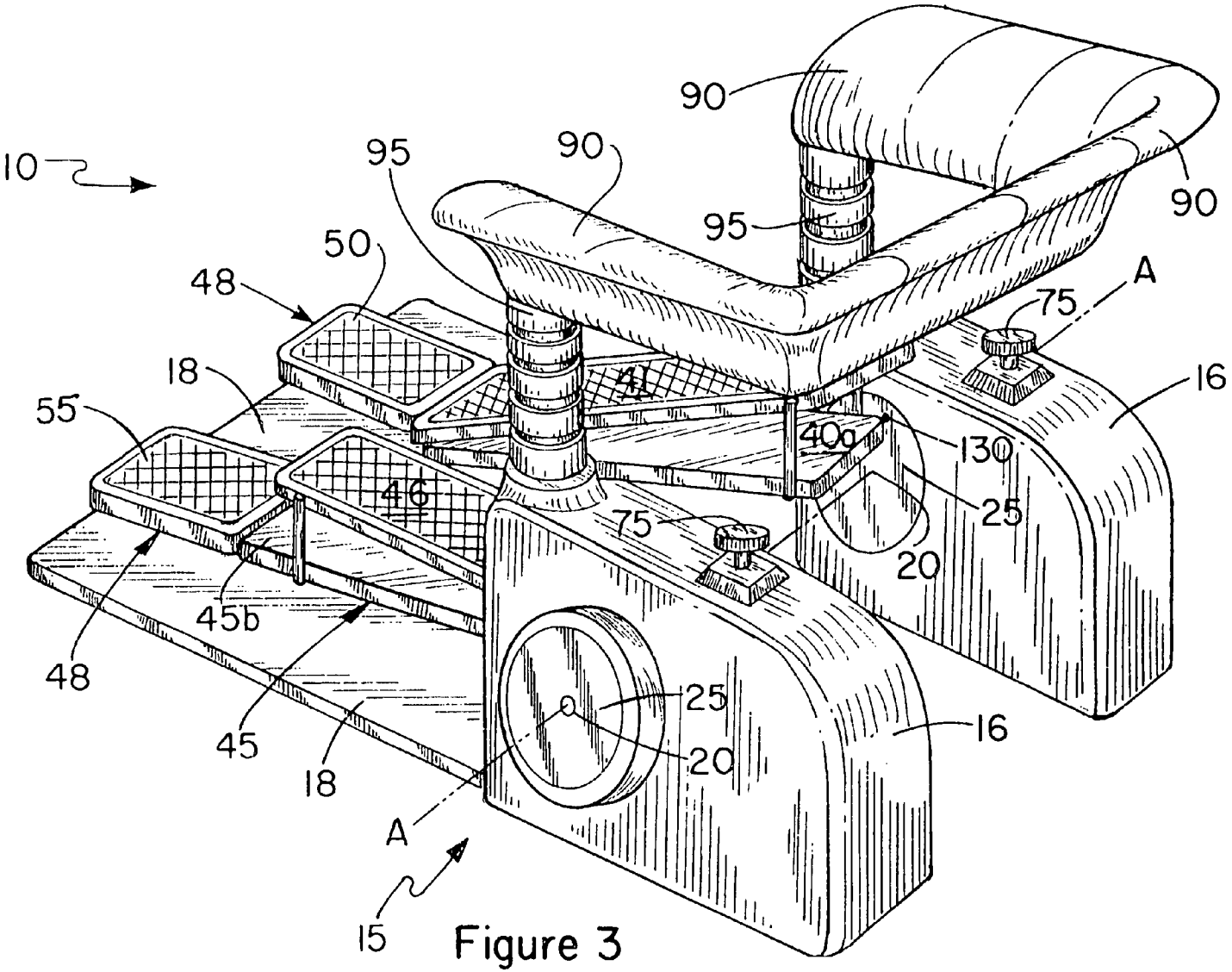
FIG. 3 is another perspective view of the FIG. 2 embodiment of the exercise device of the present invention.

The FIG. 1 embodiment of the exercise device 10 further includes foot pads 41, 46, which preferably comprise pads formed at least partially of a relatively soft, high coefficient of friction material, such as rubber, polymer, natural padding, or synthetic material. Each foot pad 41, 46 rests atop the lower foot tread 40, 45, and either end of each foot pad 41, 46 can be elevated relative to the lower foot tread 40, 45, as illustrated in FIG. 3. The foot pads 41, 46 are sufficiently rigid so as to support the weight of the user, with one end of the foot pads 41, 46 elevated relative to the foot tread 40, 45. The lower foot treads 40, 45 remains pivotally attached to the wheeled members 50, 55 when one end of the foot pads 41, 46 is elevated relative to the foot treads 40, 45. That is, because of a hinge or flexure between each lower foot tread 40, 45 and each wheeled member 50, 55, the angle of elevation of a foot tread 40, 45 may change with respect to the angle of elevation of an attached wheeled member 50, 55. The feature of changing the orientation of the foot pads 41, 46 with respect to the wheeled members 50, 55 provides greater versatility in the configuration of the exercise apparatus 10 of the present invention.

It is to be noted that the preferred practice of the device of this invention the two footpads and their respective inertial systems are stabilized on a frame that connects and stabilizes the two footpad systems into a single device. However, in a less preferred embodiment, two separate footpad and inertial systems may be positioned adjacent to each other and their own mass or independent securing (e.g., bolts, screws, etc.) that can stabilize the two independent systems adjacent to each other so that the two systems effectively operate together as if they were a single device. Additionally a single footpad and inertial system unit may be used as a training system for activities where two feet or legs act synchronously, as in skateboarding or snowboarding.

Another feature of the present invention is the variable path of travel that the user's feet experience, depending upon the location of each foot on the elongated foot treads 40, 45. When positioned near the foot tread front ends 40*a*, 45*a*, the user's feet travel in a nearly circular path. When positioned near the foot tread rear end 40*b*, 45*b*, the user's feet travel in an elliptical path. Thus, greater versatility in exercise is available, depending upon the location of the user's feet on the elongated foot tread 40, 45.

In addition, the user can operate the exercise device 10 facing toward the pivot axis A, by positioning the user's feet, one on each foot pad 41, 46, with the toe portion of the user's foot nearer the pivot axis A than the heel portion of the user's foot. Alternatively, the user can operate the exercise device 10 facing away from the pivot axis A, with the heel portion of the user's foot nearer the pivot axis A than the toe portion of the user's foot.

With the toe portion of the user's feet nearer the pivot axis A, and when the rear end 40*b*, 45*b* of each foot tread member 40, 45 travels along the reciprocating path of travel in a direction away from the pivot axis A, the toe portion of the user's foot associated therewith initially lowers at a rate faster than the heel portion of the user's foot, and when the rear end 40*b*, 45*b* of each foot tread member 40, 45 travels along the reciprocating path of travel in a direction toward the pivot axis A, the toe portion of the user's foot associated therewith initially rises at a rate faster than the heel portion of the user's foot.

Conversely, with the heel portion of the user's feet nearer the pivot axis A, and when the rear end 40*b*, 45*b* of each foot tread member 40, 45 travels along the reciprocating path of travel in a direction away from the pivot axis A, the heel portion of the user's foot associated therewith initially lowers at a rate faster than the toe portion, and when the rear end 40*b*, 45*b* of each foot tread member 40, 45 travels along the reciprocating path of travel in a direction toward the pivot axis A, the heel portion of the user's foot associated therewith initially rises at a rate faster than the toe portion.

Referring now to FIGS. 2-4 and 6, another embodiment of the exercise device 10 of the present invention is shown. The exercise device 10 includes a frame member 15 adapted for being supported on a floor or other such surface. The frame member 15 has a pivot axis, A, defined therein, as for example by one or more shafts 20 passing through and supported by the frame member 15. In the embodiment illustrated in FIGS. 2-4, the shafts 20 each have a rotating wheel member 25 supported thereupon for rotation about the pivot axis A. The frame member 15 includes housings 16 which support the shafts 20 and rotating wheel members 25, with the housings 16 joined by a rigid connector member 17 for holding the housings 16, shafts 20 and rotating wheel members 25 in a constant orientation. The frame member also includes a planar plate member 18 described below. The exercise device 10 further includes a first and a second spindle 130, 135, pivotally mounted to each rotating wheel member 25 for rotation about the axis A. The exercise device 10 further includes a first and a second foot tread member, 40, 45, respectively. The foot tread members 40, 45 are generally elongated members having a front end 40*a*, 45*a*, a rear end 40*b*, 45*b*, and two sides 40*c*, 45*c*, respectively. The foot tread member front ends 40*a*, 45*a*, are pivotally connected to the coupling member (in this instance the spindles 130, 135) in such a manner so as to permit travel of the front ends 40*a*, 45*a* of the foot tread members 40 and 45 in an arcuate path of travel about the pivot axis A at a predetermined length, corresponding to the distance of the spindles 130, 135 from the axis of the rotating wheel members 25. Within the context of this application, "arcuate" will refer to a circular, oval, elliptical or other such closed, curved path of travel.

A rear end 40*b*, 45*b* of the foot tread members 40 and 45, moves in a reciprocating path of travel as each foot track member 40, 45 travels in an arcuate path. The rear ends 40*b*, 45*b* of the foot track members 40, 45 may be suspended by cables, rods, straps, belts or similar suspension means, or may simply ride directly on a suitable support surface associated with the planar plate member 18. Preferably, the rear end 40*b*, 45*b* of the foot tread members 40 and 45, respectively, terminates in a glide member 48 having a sliding, gliding, rolling or otherwise friction reducing function, yet including a support and guiding function for the foot tread member rear ends 40*b*, 45*b*. In the present embodiment of FIGS. 2-6, the glide members 48 comprises wheeled member 50, 55 best seen in FIGS. 5 and 6. Other embodiments of the glide members 48 secured to the foot tread member rear ends 40*b*, 45*b*, includes Teflon® glides, pin glides, ball glides, belt glides, hydraulic supports and other equivalent elements that provide a function of reducing friction. In the embodiment of FIGS. 2-6, the wheeled members 50, 55 engage linear tracks 60, 65. The tracks 60, 65 direct the rear ends 40*b*, 45*b* of the foot tread members 40, 45 in a reciprocal path of travel as the front ends 40*a*, 45*a* of the tread members 40, 45 travel about the pivot axis A. Preferably, the linear tracks 60, 65 are located on the surface of the planar plate member 18 of the frame member 15. Within the context of this application, a "reciprocal" path of travel is meant to define any back and forth path of travel which is repetitively traversed by the end of the foot tread members 40, 45 and includes a generally linear path of travel, as is provided by the tracks 60, 65 of the FIGS. 2-4 embodiment shown herein. It is important to note that each foot track member 40, 45 moves independently of the other foot track member. The force applied to one foot track member by a user in no way influences the movement of the other foot track member. This configuration allows the foot track members 40, 45 to move in tandem or in unison. Additionally, the independence of each foot track member 40, 45 allows each to move in the same direction, i.e., clockwise or counter clockwise, or one to move clockwise and the other to move counter clockwise. This feature of the present invention provides for greater versatility in the number and complexity of exercises and movements available to the user.

Figure 2:
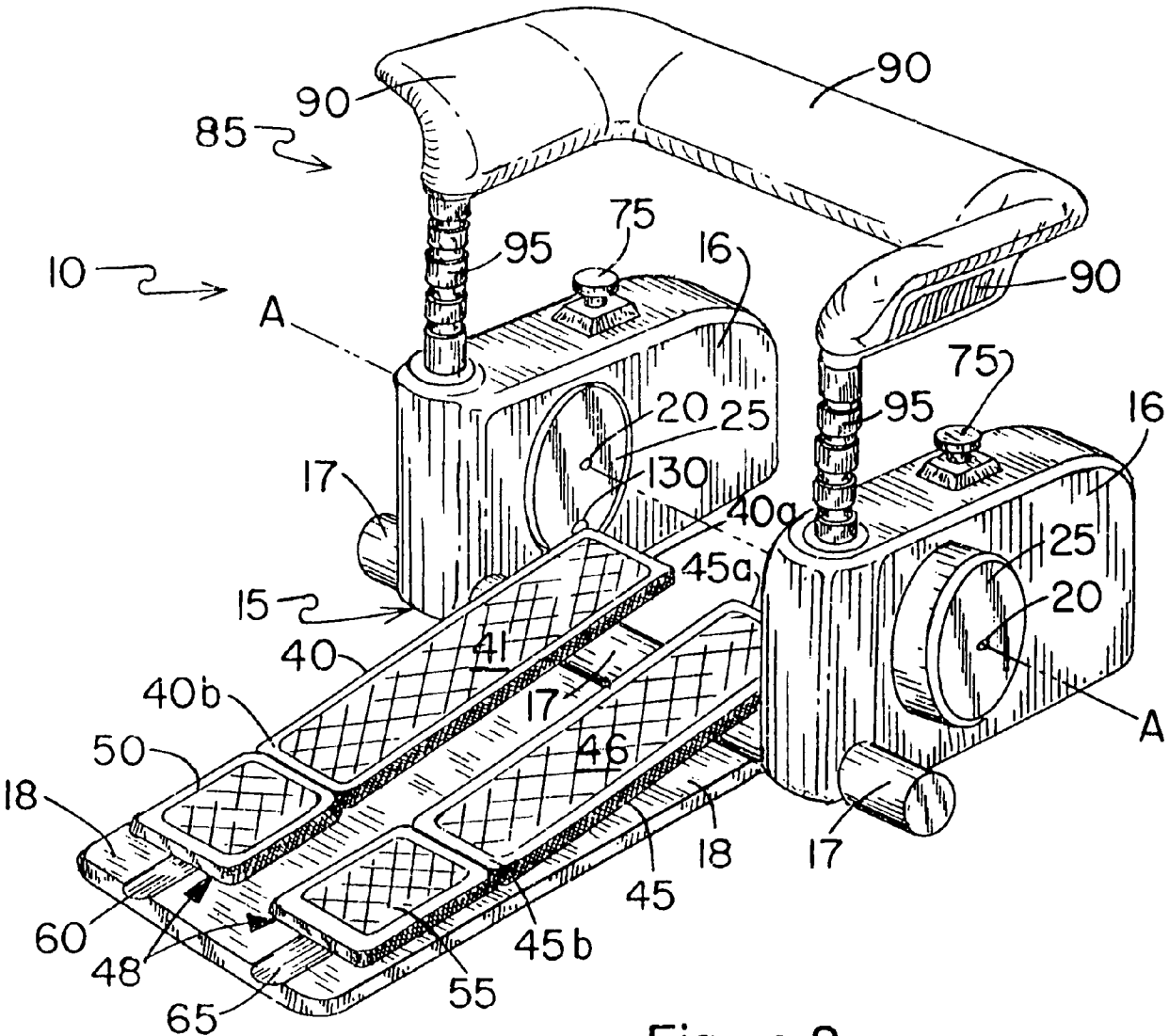
FIG. 2 is a perspective view of another embodiment of the exercise device of present invention.
Figure 4:
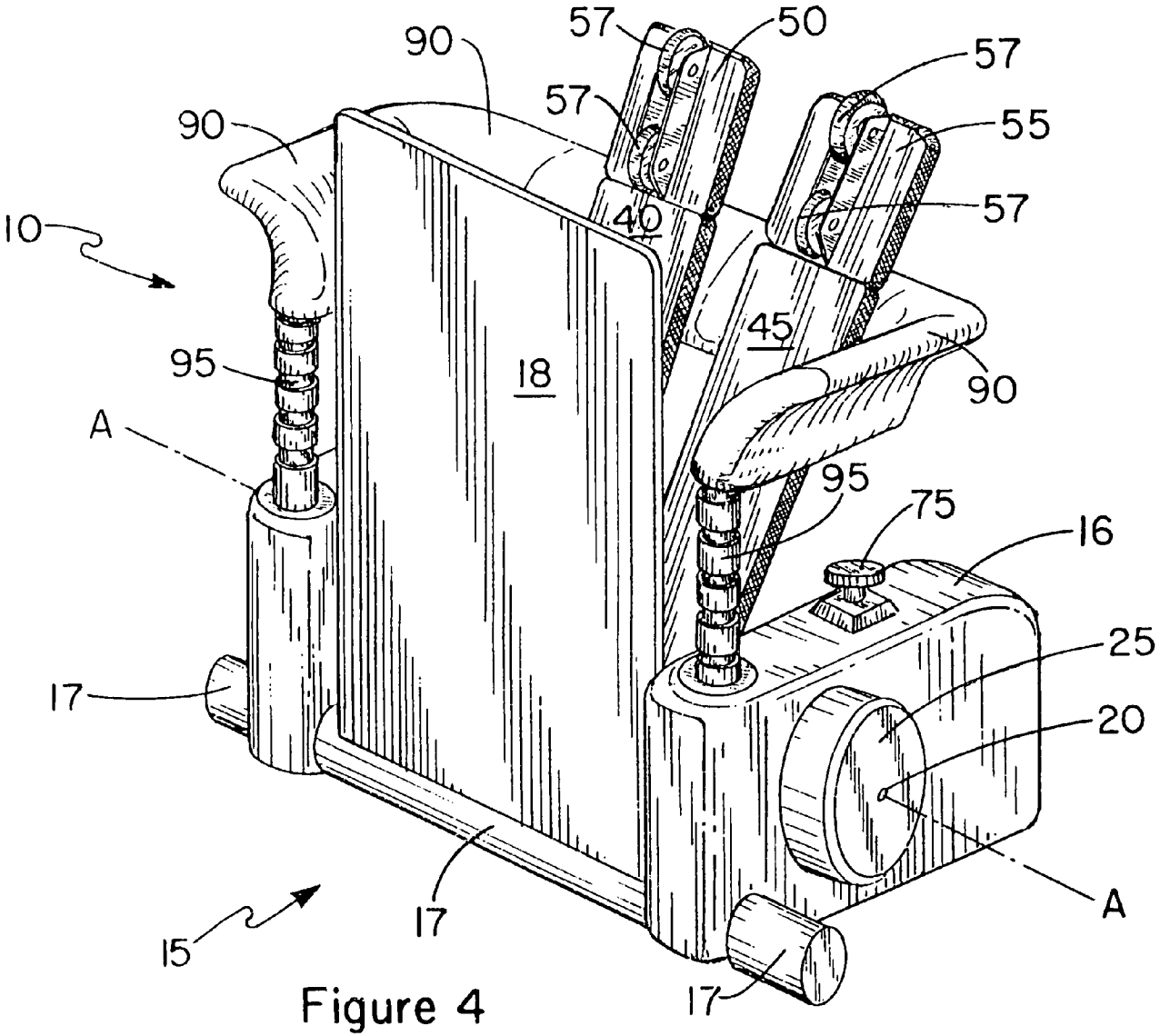
FIG. 4 is a perspective view of the FIG. 2 embodiment of the exercise device of the present invention when it is folded for storage.

The apparatus of the FIGS. 2-4 embodiment may further include friction brakes 70, associated with each rotating wheel member 25, for purposes of imposing drag on the wheel 25 so as to increase the amount of exercise provided by the exercise apparatus 10, as illustrated in FIG. 6. The friction brakes 70 are enclosed within the frame housing 16 and may be adjusted by an adjustment knob 75 operating upon the friction pad of the brake assembly, as is well known to those of skill in the art. Other types of physical, mechanical or electrical braking devices such as a magnetic brake, hydraulic brake, friction brake, and the like, may be similarly employed. In the illustrated embodiment, the frame member 15 includes a user support member 85 mounted upright to the frame member 15. Preferably, the user support member 85 includes a U-shaped portion 90 with a pair of vertical legs 95, each leg 95 adjustably secured to one of the two housings 16 of the frame member 15.

The FIGS. 2-4 embodiment of the exercise device 10 further includes foot pads 41, 46 which preferably comprise pads formed at least partially of a relatively soft, high coefficient of friction natural or synthetic material, such as rubber. Each foot pad 41, 46 rests atop the lower foot tread 40, 45, and one end of each foot pad 41, 46 can be elevated relative to the lower foot tread 40, 45, as illustrated in FIG. 3. The foot pads 41, 46 are sufficiently rigid so as to support the weight of the user with one end of the foot pads 41, 46 elevated relative to the foot tread 40, 45. The lower foot treads 40, 45 remains pivotally attached to the wheeled members 50, 55 when one end of the foot pads 41, 46 are elevated relative to the foot treads 40, 45. The feature of changing the orientation of the foot pads 41, 46 provides greater versatility in the configuration of the exercise apparatus 10 of the present invention.

Another feature of the present invention is the variable path of travel that the user's feet experience, depending upon the location of each foot on the elongated foot treads 40, 45. When positioned near the foot tread front ends 40*a*, 45*a*, the user's feet travel in a nearly circular path. When positioned near the foot tread rear end 40*b*, 45*b*, the user's feet travel in an elliptical path. Thus, greater versatility in exercise is available, depending upon the location of the user's feet on the elongated foot tread 40, 45.

In addition, when the exercise device 10 is in use, and when the rear end 40*b*, 45*b* of each foot tread member 40, 45 travels along the reciprocating path of travel in a direction away from the pivot axis A, the toe portion of the user's foot associated therewith initially lowers at a rate faster than the heel portion of the user's foot, and when the rear end 40*b*, 45*b* of each foot tread member 40, 45 travels along the reciprocating path of travel in a direction toward the pivot axis A, the toe portion of the user's foot associated therewith initially rises at a rate faster than the heel portion of the user's foot.

Referring now to FIG. 4, the planar plate member 18 of the frame member 15 containing the linear track portions 60, 65, as well as the foot tread members 40, 45, with attached wheeled members 50, 55, pivot to a near vertical orientation to allow for non-obstructive storage of the exercise device 10.

Figure 5:
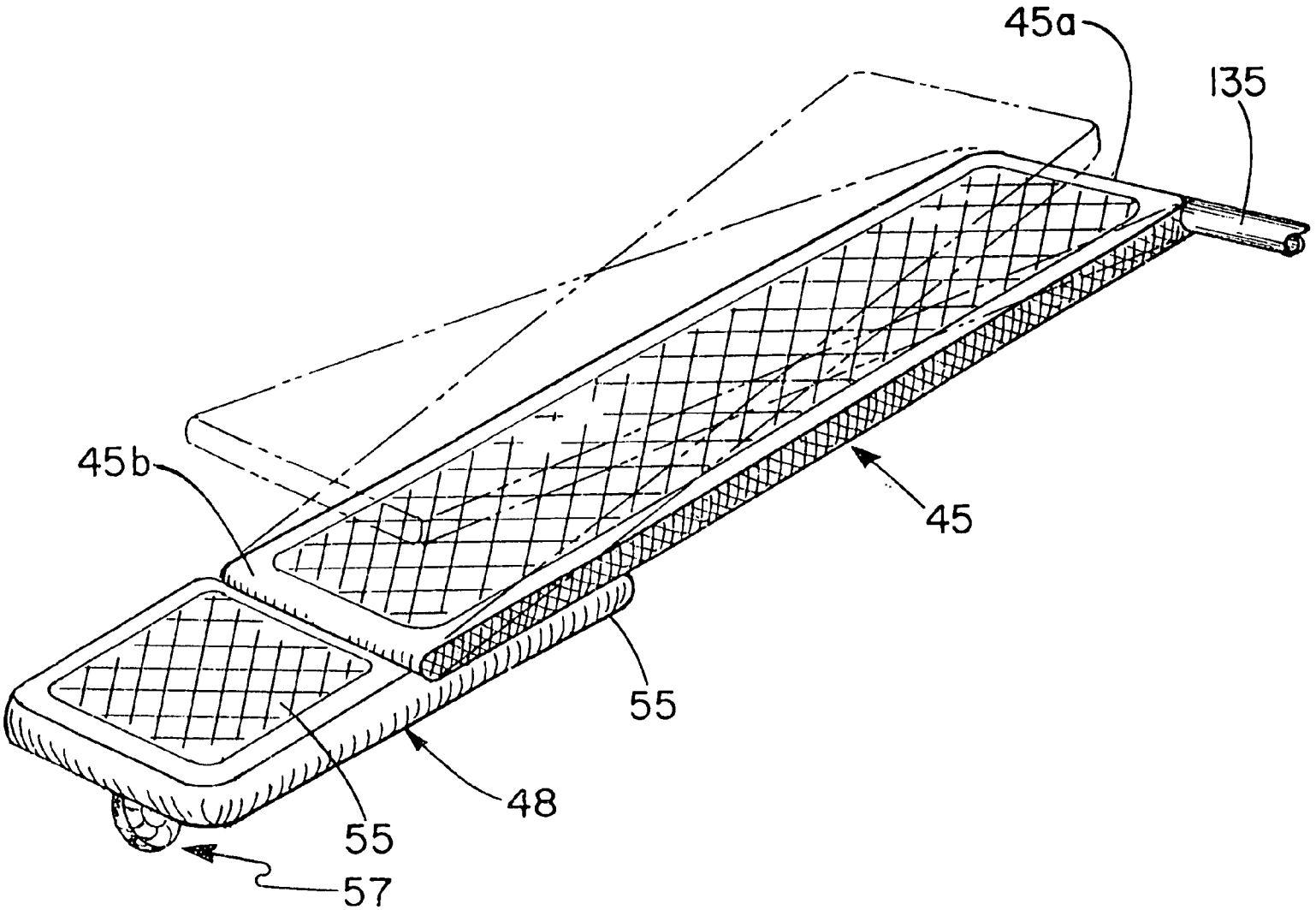
FIG. 5 is a perspective view of the foot pad member of the exercise device of the present invention.

A foot tread member 45 and attached wheeled member 55 are shown in greater detail in FIG. 5. The rear end 45*b* of the foot tread member 45 is pivotally attached to the wheeled member 55, allowing the wheeled member 55 to remain essentially horizontal as the front end 45*a* of the foot tread member 45 travels in an arcuate path, attached to either the bell crank member 35 or the rotating wheel member 25, as described above. Preferably, the wheels 57 of the wheeled members 50, 55 are in a linear configuration and aligned with the long axis of the foot tread members 40, 45. The wheels 57 of the wheeled members 50, 55 preferably travel in the linear track portions 60, 65 of the planar plate member 18.

Referring now to FIG. 6, a detailed view of one rotating wheel member 25, the fly wheel member 125, the attached foot tread member 40 and the wheeled member 50 is shown. The fly wheel member 125 is mounted on a shaft interior the frame housing 16 and operatively connected to the rotating wheel member 25 by a belt member 140. The friction brake member 70 is positioned to apply force to the fly wheel member 125, which transfers resistance to rotation to the rotating wheel member 25 via the belt member 140. The friction brake member 70 is adjusted with the brake adjustment knob 75 mounted on the surface of the frame housing 16. Alternatively, resistance to rotation of the wheel member 25 can be achieved by a magnet brake assembly (not shown) acting on the fly wheel member 125.

While the invention has been particularly shown and described with reference to preferred embodiments thereof, it will be understood by those skilled in the art that various changes in form and details may be made therein without departing from the spirit and scope of the invention.

FIG. 2 shows that the glide member 48 may have two distinct areas of contact in the foot pad portion 46 and the foot tread member 40. There may be a flexible joint 42 between the foot pad portion 46 and the foot tread member 40. The flexible joint may be a hinge, a pin, a swivel, cu0p and socket, or any other known physical structure that allows the foot pad portion 46 and the foot tread member 40 to bend and not break at the joint 42. It is also of interest to note in this embodiment (which is not required, but offers some additional unique capability) that the foot pad portion 46 covers a majority of the surface area in the foot tread member 40. This allows a user's foot to be placed along a substantial length of the pad portion 46 of the foot tread member 40. By placing the foot in different areas, the motion and range of motion and style of motion can be varied. By placing a foot with the heel closest to the wheel glide member 50, a foot motion closest to a glide is effected. By moving the foot farther away from the wheel glide member, the motion becomes more arcuate. The motion makes a transition from glide to elliptical to circular motion as the foot is placed farther from the wheel glide member 50, and closer to the U-shaped support member 90. This offers much greater flexibility in motion and exercise control, even to the point where different legs are doing different training patterns at one time. As different training programs require different motions to be available, this system provides the various motions without having to modify the construction.

It is also to be noted that it is not necessary to use straps to secure feet into position and that the friction provided by the long foot pad portion 46 can be used to provide secure foot positioning. A strap may be added, or a simple belt that slips over the foot and the foot tread member 45 for additional security. A strap or belt that secures to the sides 40*c* of the foot tread member 45 may also be provided.

As the foot pad portion 46 is likely to be subject to uneven wear in use, the foot pad portions should be replaceable easily. Having foot pad portions that slip into, snap into, fit into, or are secured into the frame of the foot tread portion 45 are desirable. A non-limiting example of such a construction is shown in FIG. 5. Note the tongue 142 that extends as part of the foot pad member 46 into the frame portion 144 of the rear end of the foot tread member 45*b*. Alternative engaging systems such as hook-and-loop fasteners (e.g., Velcro® fasteners), snaps, tongue and groove fasteners, adhesive sheets, peg and holes, slide and groove systems, and any other engaging system may be used at one, two, three or four sides of the foot pad member 46. These members should be easily removeable and easily insertable. More permanent (yet still removeable systems such as staples, screws, bolts and the like may be used, but each has its own characteristics that a designer may or may not choose.

The foot pad member covers the substantial surface of the foot tread member (e.g., most of the available surface area except for frames, printed instruction which may or may not have a friction surface, lighting, clips for shoes, belts, etc.) so that a significant area can be used by the user. The coverage of 60%, 65%, 70%, 75%, 80%, 85%, 90%, 95% up to nearly or exactly to 100% of the surface area for frictional surface or pad replacement with critical areas having friction material on or added to the pad can be used. Lower amounts of pad area could also be used.

Figure 7:
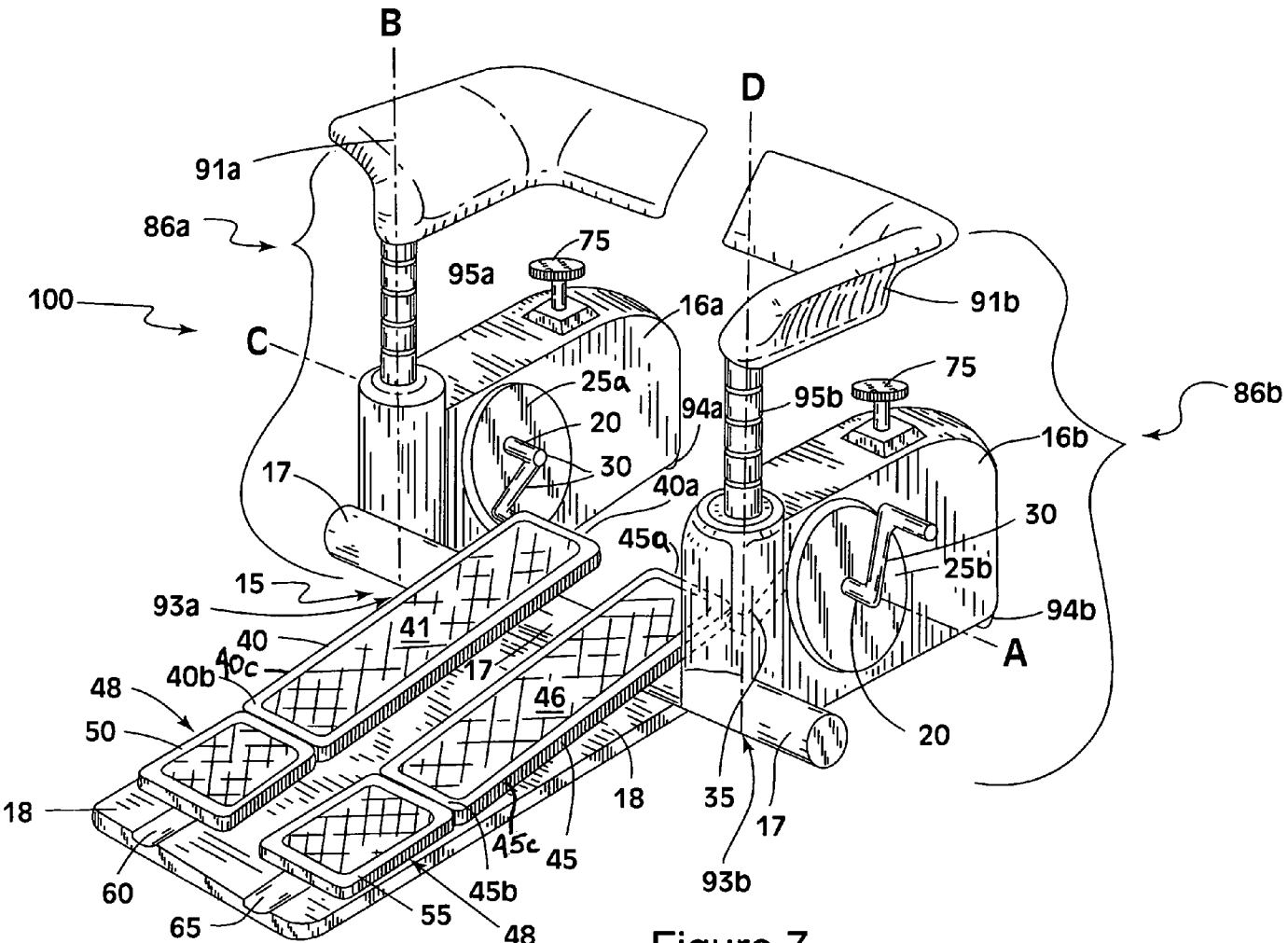
FIG. 7 shows a perspective view of an elliptical system according to the present technology.

A stationary exercise device 100 according to the disclosed technology as shown in FIG. 7 contains a first and second support member 86*a*, 86*b* in which each support member includes a housing 16*a*, 16*b*, a leg support member 95*a*, 95*b*, and a direction member 91*a*, 91*b*. And the leg support 86*a*, 86*b* goes through the housing 16*a*, 16*b*, a free end of said leg support 86*a*, 86*b* is pivotally affixed to a rigid connector 17, and a second free end is connected to the direction member 91*a*, 91*b*. Within the context of this application, a "direction member" is defined as where the user places his/her hands to balance or move each supporting member 86*a*, 86*b*. Preferably, each housing 16*a*, 16*b* could have some type of stationary glide member 94*a*, 94*b* attached to the front of the housing 16*a*, 16*b* to provide inward movement to the different angles. Preferably, the angles would range from 90 to 0 degrees relative to the rigid connector member 17. Within the context of this application, an "stationary glide member" is defined as an element having a sliding, gliding, rolling or otherwise friction reducing function, yet including a support and guiding function for the housing 16*a*, 16*b*.

Each first and second support member 86*a*, 86*b* will pivot about a vertical pivot axis B, D respectively when connected to the rigid connector member 17 to provide inward movement of the first and second support members 86*a*, 86*b*. Each direction member 91*a* and housing 16*a*, of the first and second support member 86*a*, 86*b* must not interfere with the other direction member 91*b* and housing 16*b* of the first and second support member 86*a*, 86*b* when each first and second support member 86*a*, 86*b* pivots inward. A first foot tread 40 and second foot tread 45, each first and second foot tread member 40, 45 having a front and rear end 40*a*, 45*a*, and each first and second foot tread member 40, 45 travels in a reciprocating arcuate path about each transverse axis C, A respectively.

When each supporting member 86*a*, 86*b* pivots inward, the reciprocating arcuate path of the front end 40*a*, 45*a* of the foot tread member 40, 45 operatively associated with that supporting member 86*a*, 86*b* travels in a nearly circular path and the rear end 40*b*, 45*b* of the foot tread member 40, 45 becomes fixed.

A stationary elliptical exercise device 100 according to the present invention includes at least one inertial mass or rotational resistance component 25*a*, 25*b* providing rotational movement which has a plurality of weights disposed equally about a circumference of the inertial mass. Preferably, there are two inertial masses, one for each foot tread member 40, 45. Preferably, the inertial mass 25*a*, 25*b* would be surrounded by a housing 16*a*, 16*b* that does not restrict rotational movement. The greater the overall mass of the rotational resistance component 25*a*, 25*b*, the greater the force needed for initial rotational movement. Therefore, the toe portion of the user's foot needs to exert more force of the front end 40*a*, 45*a* of each first and second foot tread member 40, 45 to initiate arcuate movement. The size and shape of the rotational resistance component 25*a*, 25*b* has several possibilities. However if the embodiment includes support members 91*a*, 91*b* that pivot inward, then the size and shape of the rotational resistance component 25*a*, 25*b* surrounded by a housing 16*a*, 16*b* should be restricted as to not interfere with the other housing 16*a*, 16*b* containing the other rotational resistance component 25*a*, 25*b*.

An alternative perspective on the technology described herein comprises as a stationary elliptical exercise device 100. The device may comprise: at least one inertial mass or rotational resistance component 25*a*, 25*b* providing inertial resistance to rotational movement, which resistance is transferred to foot tread movement. The inertial mass 25*a*, 25*b* may comprise a plurality of attachable and removeable weights radially disposed about a point of rotation of the inertial mass 25*a*, 25*b*. The attachment and removal should be simple to facilitate easy replacement and adjustment, as by snaps, screws, clips, toggles and the like. The plurality of weights may be attached symmetrically or eccentrically about the inertial mass 25*a*, 25*b*. Preferably they may be with a single plane of rotation or define a wider volume of rotation. At least some components of each individual inertial mass may comprise a coupling member for foot tread members 40, 45, at least two of the coupling members (in this instance the bell cranks 30, 35) comprising a front end 40*a*, 45*a* of each of a first foot tread member 40, 45 and a front end 40*a*, 45*a* of a second foot tread member 40, 45 pivotally affixed to an at least one inertial mass. The stationary elliptical exercise device 100 may have at least two inertial masses each comprising a coupling member (in this instance the bell cranks 30, 35), each coupling member comprising a front end 40*a*, 45*a* of each of a first foot tread member 40, 45 or a second foot tread member 40, 45 pivotally affixed to an at least one inertial mass 25*a*, 25*b*. Two of the at least two inertial masses may be separately attached to only one of the first foot tread member 40, 45 and the second foot tread member 40, 45. The stationary elliptical exercise device 100 may further comprise a housing 16*a*, 16*b* that surrounds said inertial mass 25*a*, 25*b* and is connected to a rigid connector member 17 and a device structural leg support 95*a*, 95*b*.

Another description can be as a stationary exercise device 100 comprising: a first support member 91*a* for a first pivoting element 93*a* attached to a first rotational resistance component 25*a* and a second supporting member 91*b* for a second pivoting element 93*b* attached to a second rotational resistance component 25*b*. Each first and second support member 91*b* has a transverse axis C, A for each rotational resistance component 25*a*, 25*b* and a vertical pivot axis B, D. Each first and second support member 91*a*, 91*b* pivots about each vertical pivot axis B, D. There is a first foot tread member 40 and second foot tread member 45. Each first and second foot tread member 40, 45 having a front 40*a*, 45*a* and rear 40*b*, 45*b* end. Each first and second foot tread member 40, 45 front end 40*a*, 45*a* travels in an arcuate path about each transverse axis C, A. As each support member 91*a*, 91*b* pivots inward, a prescribed reciprocating arcuate path of the front ends 40*a*, 45*a* of each respective first and second foot tread member 40, 45 is imposed. That arcuate path remains parallel to a plane of rotation of the rotational resistance component 25*a*, 25*b*.

A further alternative description is as a stationary exercise device 100 comprising: a first support member 91*a* for a first pivoting element 93*a* attached to a first rotational resistance component 25*a* and second supporting member 91*b* for a second pivoting element 93*b* attached to a second rotational resistance component 25*b*. Each first and second support member 91*a*, 91*b* has a transverse axis C, A for each rotational resistance component 25*a*, 25*b* and a vertical pivot axis B, D, and each first and second support member 91*a*, 91*b* pivots about each vertical pivot axis B, D. The first foot tread member 40 and second foot tread member 45, each first and second foot tread member 40, 45 having a front 40*a*, 45*a* and rear 40*b*, 45*b* end, and each first and second foot tread member front end 40*a*, 45*a* travels in an arcuate path about each transverse axis C, A. As each support member 91*a*, 91*b* pivots inward, a prescribed reciprocating arcuate path of the rear ends 40*b*, 45*b* of each respective first and second foot tread member 40, 45 is imposed changes between a longest path defining a tread movement plane parallel to a plane of rotation defined by a respective rotational resistance component 25*a*, 25*b* and a fixed stationary point for the respective rear end 40*b*, 45*b*.

The stationary exercise device 100 may have the first and second support member 91*a*, 91*b* comprises a housing 16*a*, 16*b*, a leg support 95*a*, 95*b*, and a direction member 91*a*, 91*b*, and the leg support 95*a*, 95*b* traverses said housing 16*a*, 16*b*, a free end of said leg support 95*a*, 95*b* is pivotally affixed to a rigid connector 17, and a second free end is connected to said direction member 91*a*, 91*b*. Each support member 91*a*, 91*b* may pivot according to design specification, preferably at least 45 degrees, at least 60 degrees, at least 75 degrees pivots or even at least about 90 degrees.

The stationary exercise device 100 may have the rotational resistance component 25*a*, 25*b* comprising an at least one inertial mass or rotational resistance component 25*a*, 25*b* providing inertial resistance to rotational movement wherein the inertial mass 25*a*, 25*b* comprises a plurality of attachable and removeable weights radially disposed about a point of rotation of the inertial mass 25*a*, 25*b*.

FIG. 7 shows a perspective view of an elliptical system 100 according to the present technology.

Figures 8, 9, 10, 11:
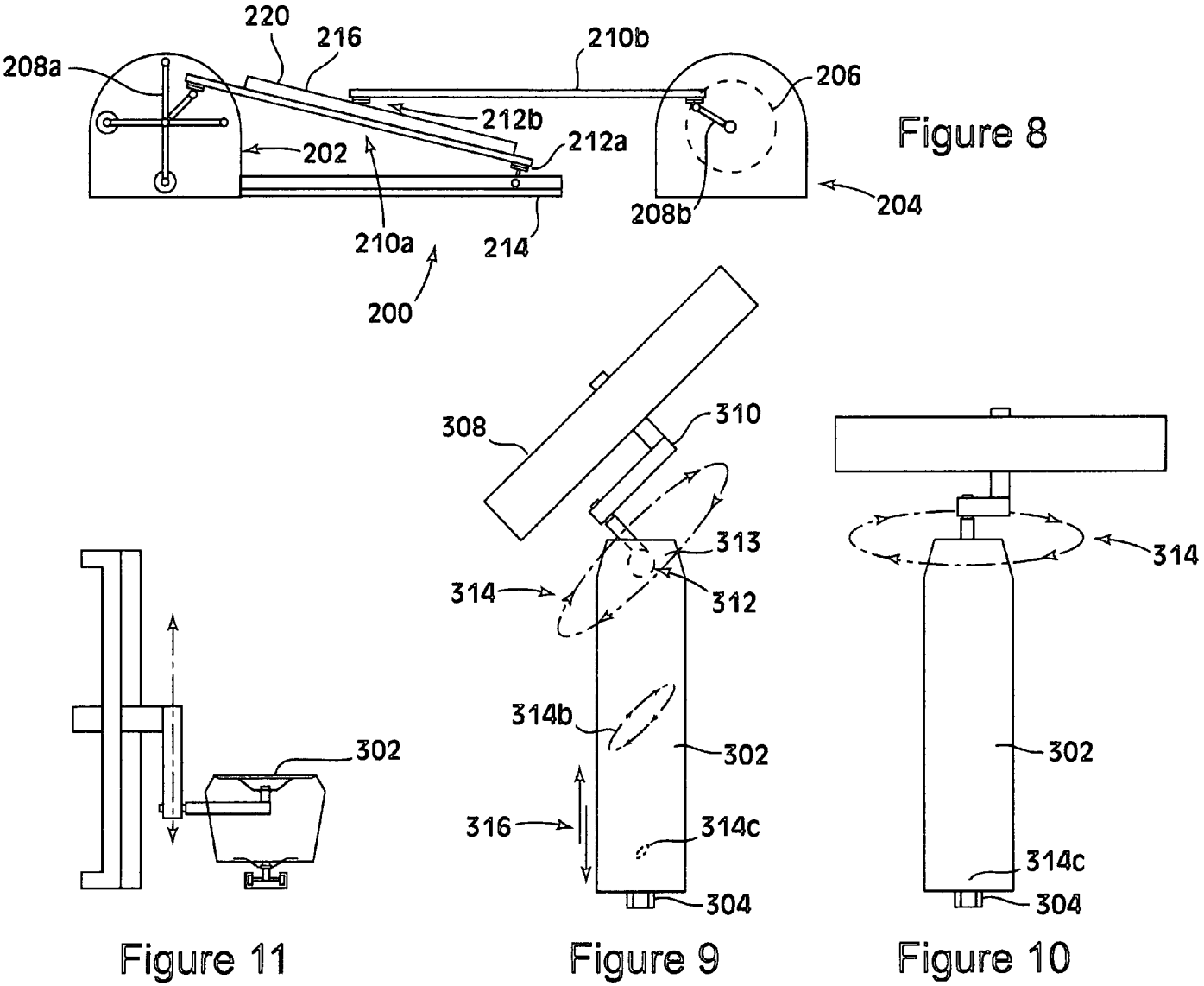
FIG. 8 shows a side view of an elliptical system where footpads are engaged with each other.
FIG. 9 shows a top view of a single foot pad in a transitional orientation adjusting the plane of movement of a front end of the footpad.
FIG. 10 shows a top view of a single foot pad having completed a transitional orientation adjusting the plane of movement of a front end of the footpad to ninety degrees from an original plane of movement.
FIG. 11 shows a rearward looking view of a single foot pad before any transitional orientation has adjusted the plane of movement of a front end of the footpad from a forward and rearward movement, without any sideways movement of the front of the footpad.

FIG. 8 shows another distinct format on which the described technology may be practiced and which can provide benefits without all previous features of the technology needing to be included. The elliptical system 200 has two separate resistance or inertial providing components 202 and 204. A weight/mass adjustable inertial component 206 is shown inside of one of the resistance providing components 204, although this is a preferred option and not a requirement for the new structure.

Each of the resistance/inertial components 202 and 204 are provided with associated rotational levers 208*a* and 208*b*, respectively. These rotational levers 208*a* and 208*b* are in turn connected to foot pads or footpad support surfaces 210*a* and 210*b*, respectively. The foot pads or footpad support surfaces 210*a* and 210*b* are respectively engaged in a sliding manner with guiding or sliding tracks 214 and 216. The sliding or guiding engagement between the guiding or sliding tracks 214 and 216 and the respectively associated foot pads 214 and 216 may be with any type of engaging glide systems such as the ball in track systems 212*a* and 212*b* shown in the figure. Any other glide engaging system that allows for at least forward and rearward movement while tolerating angular displacement in the vertical direction because of the respective angle changes resulting from the height changes in the lever components 208*a* and 208*b* may be used. One unique aspect of this system is the fact that the area 220 on top of the lower footpad surface 216 is sufficient in area as to allow a foot to be present so that there is always a significant forward and rearward displacement of the user's two feet, and the system may be used with the user facing perpendicular to the perspective of the image, with shoulders in parallel alignment with the footpads. This system 200 can enable a very eccentric motion that is desirable for training complex foot movements as might be experienced in Nordic skiing, and Alpine skiing. This system may be described as an elliptical exercise device comprising two resistance components and two footpads, each of the two resistance components being connected to a footpad, wherein the two resistance components are oriented with a longitudinal displacement with both footpads extending in the longitudinal direction, with a front end of one footpad engaged with a top surface of the other footpad so that the two footpads remain in an engaged relationship as a user operates the elliptical exercise device.

FIG. 9 shows a top view of a single footpad 302 in a transitional orientation adjusting the plane of movement 314 of a front end of the footpad 302. The footpad glides along a track 304 and is provided with resistance by component 308 which may be internal friction providing resistance and/or inertial providing resistance. The resistance component 308 is connected by a lever or crank 310 to a front end 313 of the footpad 302 through a ball joint 312 or other free rotational connection. The angle or plane of movement 314 of the front 313 of the foot pad in this Figure has shifted from zero degrees (parallel to the glide path) to about 45 degrees by rotation of the resistance component 308. The total diameter of this plane of movement 314 (the movement defines a circular plane segment as the crank end moves in a circle) remains constant in size, but its angle moves along with the pronation or orientation of the resistance component 308. The sideways component of the angle of movement and plane definition for the end 314, middle 314*b* and rear 314*c* points on the footpad 302 also change with this variation. Assuming that the rear point 314*c* was the actual connection point of the footpad 302 to the glide track 304, the defined plane and orientation of movement 314*c* would move between a maximum distance of movement backwards and forwards when the resistance component moved in a plane parallel to the footpad 302 and essentially zero movement (except rotation) when the resistance component 308 had been moved to a location perpendicular to the length of the foot pad 302. This feature and orientation is shown in FIG. 10, wherein the plane of movement of the front of the footpad 314 is perpendicular to the glide path 304 and there is essentially only pivoting or rotation about point 314*c* with essentially no forward-rearward component and essentially no sideways component of linear movement.

FIG. 10 shows a top view of a single footpad 302 having that completed a transitional orientation adjusting the plane of movement of a front end 314 of the footpad to ninety degrees from an original plane of movement.

FIG. 11 shows a rearward looking view of a single footpad 302 before any transitional orientation has adjusted the plane of movement of a front end of the footpad from a forward and rearward movement, without any sideways movement of the front of the footpad.

Figure 12:
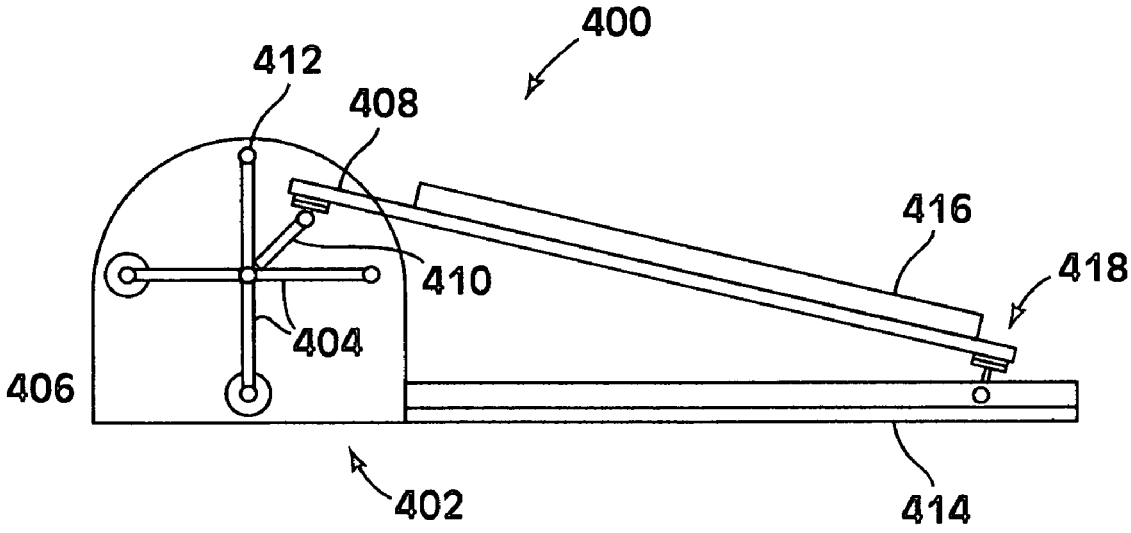
FIG. 12 shows a side view of an elliptical element inertial resistance component.

FIG. 12 shows a side view of an elliptical element inertial resistance component 400. The component 400 is shown with an inertial mass resistance element 402 comprising arms 404 and replaceable/removable/moveable mass elements 406. The replaceable mass elements are shown as screw on weights (mass) but may be snap-on mass, locking clips or clamps may be provided, or nesting areas for the weights may be provided, with some securing capability to assure that the weights do not shift or do not fall off as the mass resistance component 402 is rotated. Rotation of the mass resistance element is effected through crank 410 which is pivotally connected through pivot 412 to the base 408 of the footpad 416, which is in turn connected through back pivot joint and glide assembly 418 to a support base 414.

Figure 13:
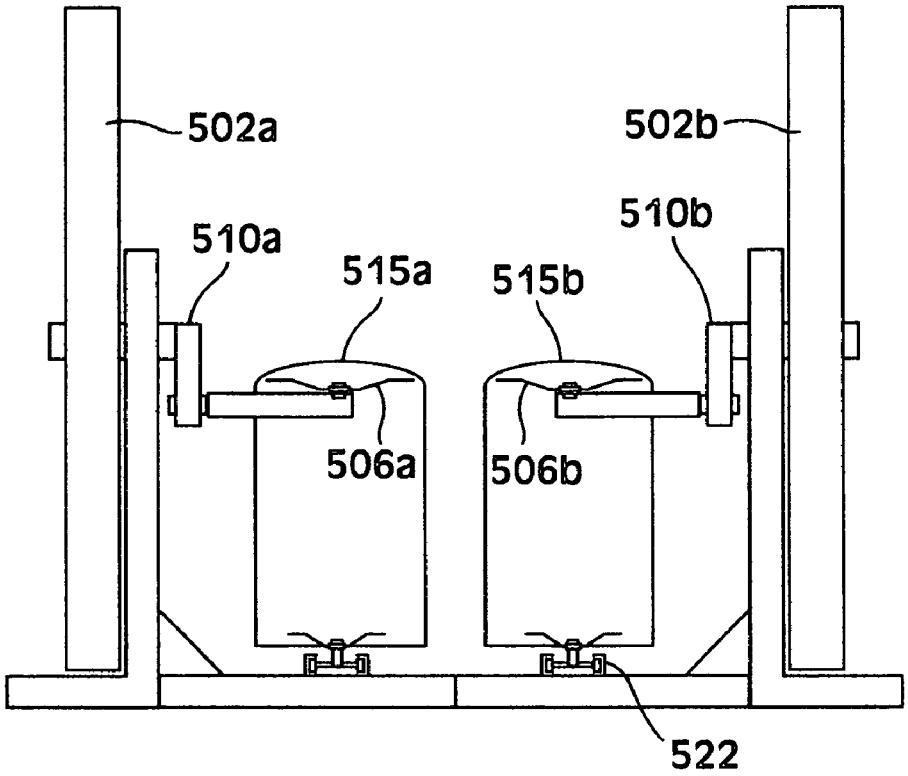
FIG. 13 shows a rearward looking view of two footpads with separate and independent inertial masses and independent rotation capability for the two inertial masses.

FIG. 13 shows a rearward looking view of two footpads 515*a* and 515*b* with separate and independent inertial masses 502*a* and 502*b* and independent rotation capability for the two inertial masses 520*a* and 502*b*. The two independent cranks systems 510*a* and 510*b* are shown to be able to swivel independently about rotation device or pivot devices 506*a* and 506*b*, respectively, as described above. As is shown attached to footpad 515*a*, the footpad 515*a* is seated on a roller or glide 522 which is engaged with a guide 522 to control the orientation and direction of movement of the footpad 515*a* from the rear of the footpad 515*a*.

Figure 14:
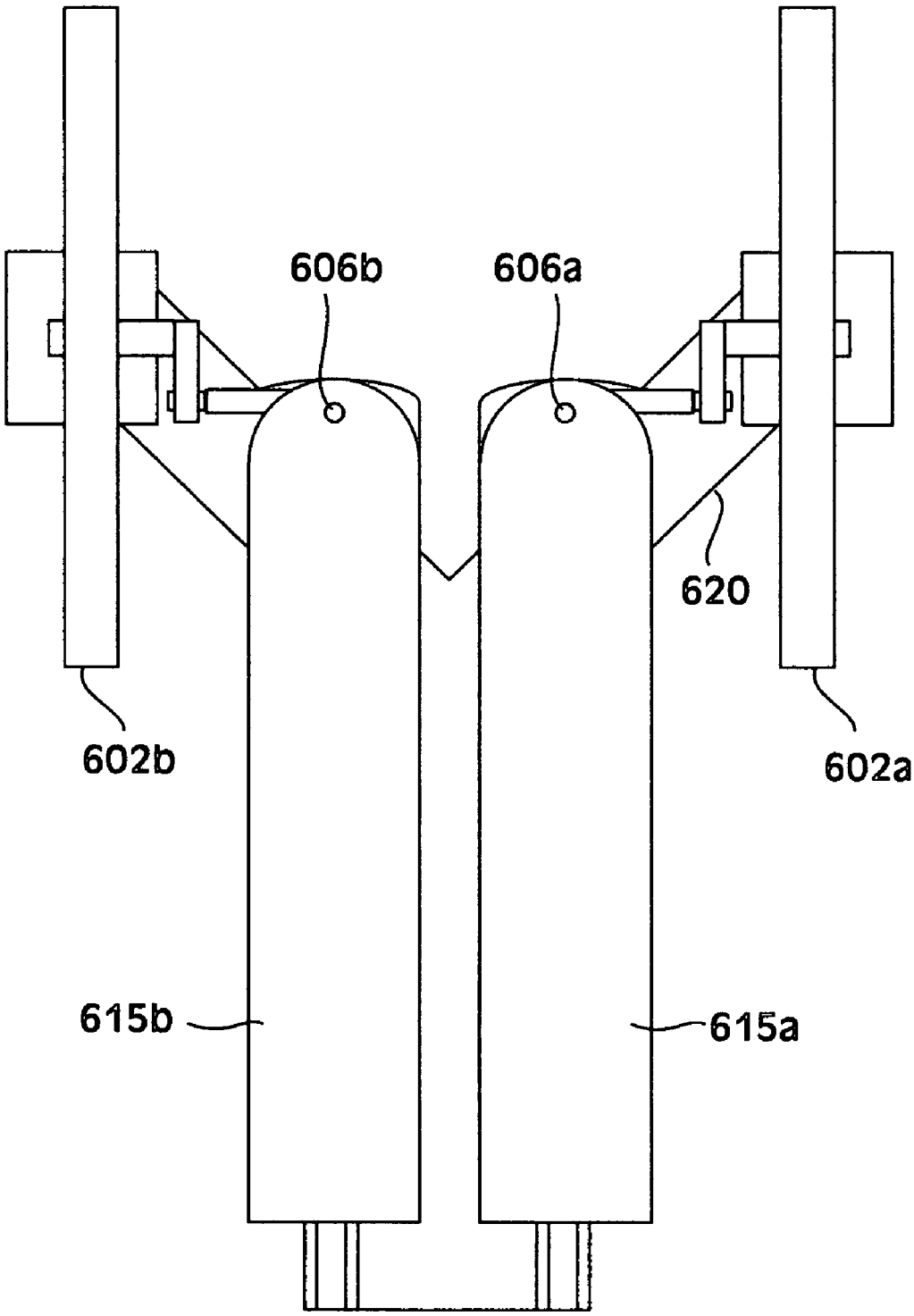
FIG. 14 shows a top view of two footpads with separate and independent inertial masses and independent rotation capability for the two inertial masses.

FIG. 14 shows a top view of two footpads 615*a* and 615*b* with separate and independent inertial masses 602*a* and 602*b* and independent rotation capability for the two inertial masses 602*a* and 602*b*. Also shown are the pivot points and rotation points 606*a* band 606*b* and the support 620 that remains stationary as the individual inertial masses 602*a* and 602*b* rotate. It is desirable to have either the footpads 615*a* and 615*b* offset from each other ((i.e., their firthest forward positions, one footpad is farther forward so that edges of the inertial masses do not bump when both are rotated ninety degrees. This may also be accomplished by extending one or more cranks and the attached inertial mass further to the side of the footpad.

Figure 15:
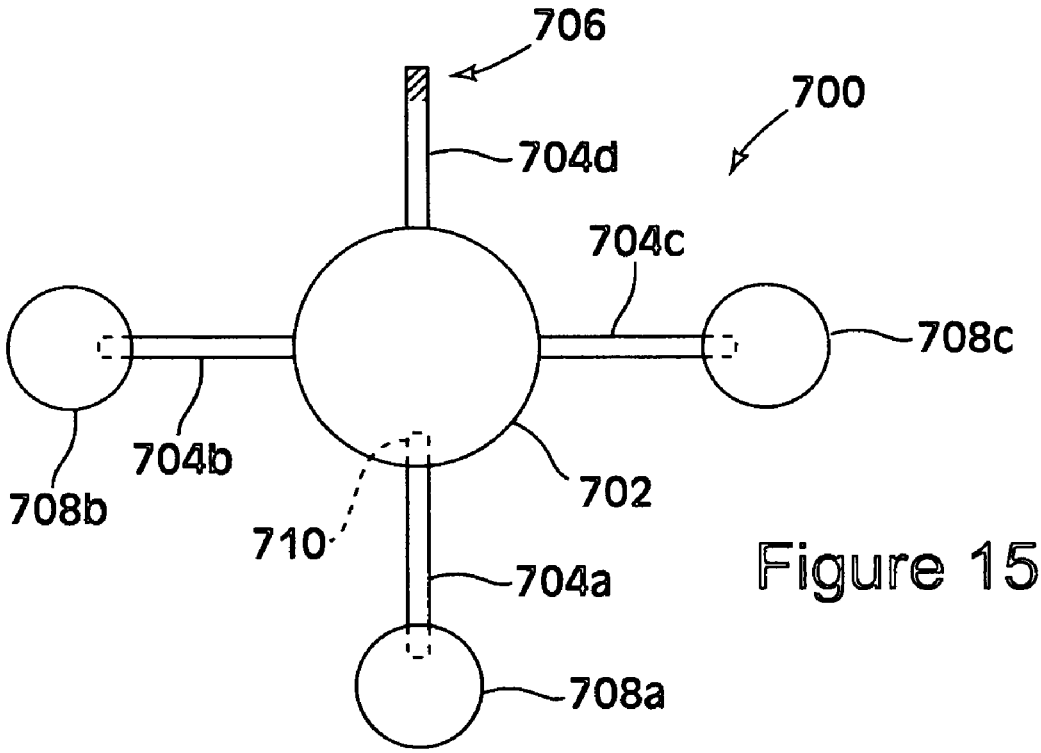
FIG. 15 shows an adjustable mass inertial component.

FIG. 15 shows an adjustable mass inertial component 700. The component 700 has a central component 702 that engages with a crank (not shown). The central component 702 is shown with four separate arms 704*a* 704*b* 704*c* 704*d* extending radially outward. The separate arms 704*a* 704*b* 704*c* 704*d* are shown symmetrically disposed, although this is not critical because of the relatively low speed of rotation of the interial component 700 during use. The separate arms 704*a* 704*b* 704*c* 704*d* are show fixed to the central component 702, with the masses 708*a* 708*b* 708*c* being added at the end of the separate arms 704*a* 704*b* 704*c* 704*d*. As shown on arm 704*d*, a threaded area 706 is one alternative connecting system between masses and arms. Snaps, locks, clips, and other physical engaging systems may be used. Alternatively, the entire arm 704*a* and mass 708*a* may engage and disengage from the central component 702 through engaging area 710, which may also have a physical engaging system to secure the connection. By adjusting the mass of the individual masses 708*a* 708*b* 708*c*, etc., the inertia of the system can be readily adjusted. The inertial component 700 may be present within a housing on the exercise device to prevent any contact with users.

Figure 16:
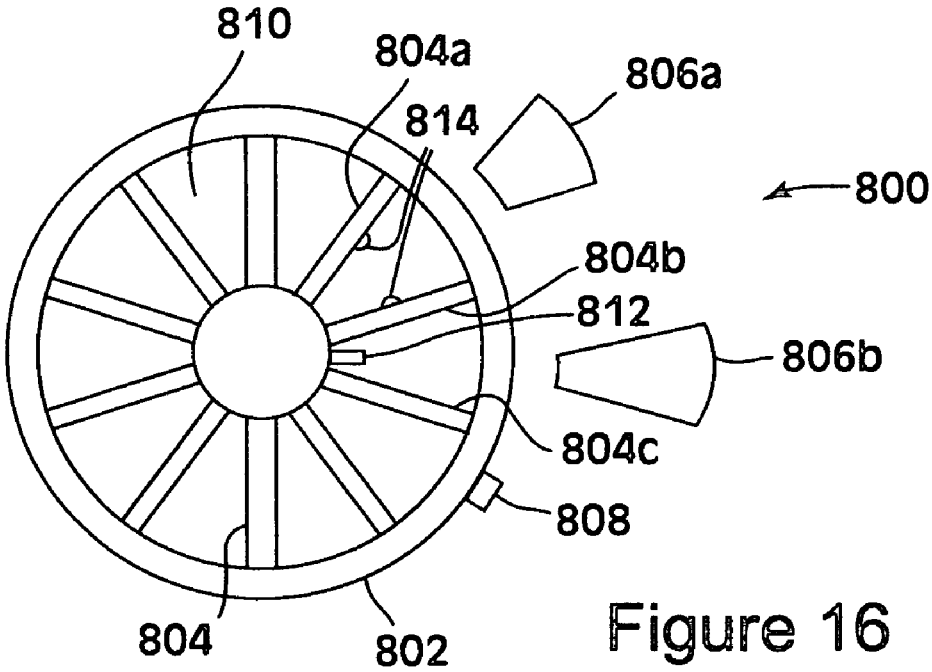
FIG. 16 shows an alternative adjustable mass inertial component.

FIG. 16 shows an alternative adjustable mass inertial component 800. The component 800 has an exterior frame 802 supported by spokes 804*a* 804*b* 804*c* etc. that define spaces or volumes or compartments 810 into which mass elements (e.g., 806*a* 806*b*) can be inserted and secured. Mass element 806*a* is shown with a configuration that will slide into an opening 810 between spokes 804*a* and 804*b*, and maintain the distribution of mass more radially outwardly and therefore more efficiently in the component 800. Mass element 806*b* extends further into an opening 810 between spokes 804*b* and 804*c*, which may be more easily secured in the component 800. Securing elements may be any physical securing system, such as, but not limited to top snap 808, engaging post 812 or side snaps 814 and the like. This format accommodates greater mass than does the earlier screw-on mass system.

Although specific examples of materials, components, subcomponents, and elements have been used, one skilled in the art would appreciate the use of other materials, components, subcomponents, and elements that would still work in providing a device as taught herein. For example, although an exercise device has been shown with two frame housings 16, a more modular unit with a single frame housing and a single foot tread member can be provided. This could enable single arm exercising or single leg exercising and could then be expanded into a two foot tread device as described elsewhere.

There are series of exercises or procedures of use of the equipment, preferably performed in order or sequences referred to herein as progressions. The precise nature of some of the series of moves and transitions between movements are unique to the independent operation of the footpads and inertial systems described herein. Because of the independent motion capabilities of the two footpads, independent, sequential and/or contemporaneous motions may be used in the series of exercises described herein.

All of the series, exercises and progressions described herein are performed on a glide system in which there are (as described herein) two decoupled footpads, with each of the decoupled footpads having individual and distinct inertial systems associated with each of the decoupled footpads. Certain concepts are to be understood in the explanation of these exercises and progressions of exercises.

Weighting and dis-weighting refer to the application of weight and force to the foot pads, with dis-weighting indicating that less than 10%, preferably less than 5%, more preferably less than 3% and most preferably less than 2% (down to essentially 0%) of the user's body mass is applied to a single foot pad. The remaining weight will be on the other foot or partially dis-weighted from the foot pads by arm support or upward momentum. The term "pick-up" refers to a complete lifting of a foot from a foot pad, particularly in a rapid movement attempting to lift the foot from a perfectly dis-weighted (less than 5% weight, or less than 2% body weight against the foot pad at the time of lift) position with regard to the foot that is being picked up. A "set-up" is the positioning of a foot pad at a specific relative position (e.g., usually midway through a half rotation from a lowermost position, e.g., with the foot pad approximately horizontal). A "hop" is a rapid shift of weight onto a single foot pad, usually to a foot pad in a set up position, and preferably by dis-weighting of one foot and transfer of all weight to the other foot, as opposed to leaping from one foot to the other by applying significant force to the one foot.

In measuring or indicating foot positions and foot pad positions, it will be assumed that there is a crank attachment of the front of a foot pad into the inertial or counterweight component. When the crank is vertically downward and the tip (front tip) of the foot pad is in its lowermost position, that position is considered "down," "all of the way down" or the "lowest position." As the foot pad is moved and the crank rotates, lifting the front tip of the foot pad, the crank will attain a relatively horizontal position which will be referred to as a midway point or midway position. If the foot pad movement has been forward (the toe of the foot moving forward), that position would be midway forward. If the initial movement were rearward (the heel of the foot being forward in the direction of initial movement from the lowest position" to the horizontal position, that would be midway rearward.

These procedures are intended to be used in combination with the unique independent foot pad systems (FPS) of the present technology with "Super Heightened Instant Force Transfer" (SHIFT) maneuvers to eliminate lower-extremity injuries and enhance lower body control. The use of the system may optionally begin with a General Adaptation Phase (GAP) where a first time user or warming up user experiments with and experiences the general range of motions available from the FPS.

A beginning point for the progressions or exercises that can be used with the equipment would comprise, by way of a non-limiting example, from a static or kinetic position, initiating a set-up, with as much weight as possible on one foot (a first foot) while the other foot (second foot) is dis-weighted, preferably to less than 1% body weight supported on the second foot while it is still in contact with the second foot pad (corresponding to the foot pad under the second foot). The set-up on the first foot leaves the second foot free to manipulate the second foot pad. A set-up is usually begun in one of the approximately midway positions or preferably with both foot pads in the same (both in forward midway positions or both rearward midway positions, although they may be in either opposed position) positions. The goal of the set up is:

Phase 1: General Adaptation Phase (GAP)

This is where the client experiences the motion for the first time with no rules or progressions just pure neuro-muscular adaptation. This phase generally constitutes a free-form effort by a user to accommodate herself/himself to the apparatus by attempts at random, but controlled movement of the two footpads by the user. A pattern may be imposed on this GAP, but that is relatively immaterial, as this is an acclimation period, not a true optimization or true skill training function. To that degree, the GAP is somewhat optional, except for reasons of safety on the system as in most warmup efforts.

Phase 2: Progression Dependent Adaptation (PDA) of Super Heightened Instant Force Transfer (SHIFT)

Progression Set 1 (A Secondary stability point is generally required, in which the user initially establishes a base position, as with both footpads parallel and equally positioned in a relatively forward/backward position, so that the two feet of the user are parallel. A user may choose an initial stabilized position of slightly skewed foot positions, or one foot slightly ahead of another, at the user's discretion. Both sides (both footpads and both feet) are assumed always at the beginning of the procedures)

A. Set Up—this position is where the client/user will put 99% of body weight on one foot so that the other foot is free to manipulate its own footpad. The goal of the set up is to leave the manipulated footpad resting as near to half way between top of swing and bottom of swing as possible. (E.g., in assuming a range of about 90°±15° forward rotation and about 90°±15° rearward rotation from a horizontal position of a footpad, the "half way position" may be measured as about 90°±10° forward, 90°±10° rearward, or measured in terms of half the height of the front or rear of the foot from the horizontal position of the footpad to the height of the front or rear of the foot at the 90°±10° extended position along the arc. The setup position should be past about 90 degrees past or before vertical (9 o'clock or 3 o'clock in rotation). This may correspond to an approximate full rotation of the crank (e.g., 180°±15° to 360°±15°, with the crank then reversing) This set up is established by adding force to the footpad to make it go down and leaving just enough force on the ensuing rise to stop the footpad half way up, the exact moment when the footpad stops the force production must be cancelled or transferred to the other footpad. The set up can be done on either side of the swing. If the force is taken off of the footpad before it stops completely the foot pad will continue to rise. This is called getting off too early. If the force is being applied to the footpad for some increment of time after the pad stops completely, the pad will continue to move downward, this is called being too late. A very large amount of visual feedback is necessary at this point for the client to transfer force off of the foot pad exactly when it stops. Failure to properly dis-weight at the exact stopping point will allow or cause the footpad to continue moving or reverse directions depending upon whether dis-weighting is premature or too late, respectively. The client should also have both primary and secondary points of stability in this phase, these stability points being feet as primary stability points and hands as secondary stability points. As the clients adapt to this progression they will start to leave the footpad with less and less movement after force transfer. As the movement after transfer (mat) becomes hard to perceive, the client will then try to leave the footpad at as close to the half swing position as possible.

B. Set Up and Hop (Unilateral)—in this progression the client will hop (Rapidly shift weight from one foot to the other foot) from the footpad that they are standing on to the footpad that they have set up, which is resting half way up, in the half point position. A true hop means that both feet cannot have weighted contact at the same time. When the clients lands on the set up footpad it will swing down and begin to rise and they will attempt to hop off of the swinging footpad exactly when it stops. If they hop off too early, the foot pad will continue to rise, if they hop off too late, the pad will continue downward. When the client makes three hops from the non-moving foot pad to the swinging foot pad with very small movement after transfer they can try to set up and hop with the other foot pad.

C. Pick Up—in this progression the client begins by swinging both footpads at the same time and in the same direction. The client will swing the footpads approximately half way up on both sides of the swing. When the swing reaches the top on either side the client will pick one foot up at the moment when both footpads reverse direction, this will leave one foot pad motionless while the client swings through the other.

D. Pick Up and Hop—after the clients perform the pick up, they will swing through the midpoint and on the ensuing rise will hop from the swinging foot pad to the other exactly when the swinging footpad stops, preferably half way up with minimal movement after transfer. Each time the pad that is swinging and begins to rise, the client prepares to transfer the force to the other pad exactly when the pad that they are swinging on stops. Again, continued motion or reversing direction of motion reflects poor timing. The force transfer must happen in the form of a hop, meaning there is never significant weighted contact on both footpads at the same time. In this progression, there is a lead footpad and a follow footpad. To ensure symmetry the client must practice with both left and right footpad leading. When the client can achieve approximately 10 hops in a row with minimal movement after transfer, it is time for the next progression.

E. No Hop, Shift, Lead Left and Lead Right—this is more complex progression from hopping to shifting without taking all force off of either footpad. The movement pattern is no different than the hops; the only major change is the client transfer a target of about 98%(±2%) of the force to the swinging footpad, while leaving a target of about 2% (±2%) of the force on the motionless footpad. As the swinging footpad rises and begins to stop the client will start to move their center of gravity to the other side and transfer force when the pad stops, minimizing movement after transfer. In this progression:

a) client's gain degrees of freedom in the overall skill b) the secondary base of support (hands) becomes less important c) most of the gravity center manipulation is done by the primary base of support (feet)

d) the remaining progression sets should be done with the primary stability point (feet) and no secondary stability points (e.g., hands) only.

Progression Set 2 (Secondary Stability Point is Not Required. Both Sides Assumed Always.

A. Alternating Forward and Alternating Backward—this progression is where the client begins to allow the footpads to swing all the way over the top position (e.g., the 30 degree swing) in an alternating cadence. Force should be produced only on the downward swinging footpad. Force should not be produced on the upward swinging footpad in order to allow the footpad to swing over the top. If force is produced on both footpads at the same time, the footpads will not be able to maintain their alternating cadence over the top. This progression should be mastered in both the forward direction and backward direction—relative to the direction of the footpad swinging motion, not relative to the orientation of the user.

B. Single Squash, Reverse Forward and Reverse Backward—this progression is where the user now applies force on one of the upward swinging footpads. When the upward swinging footpad comes to a complete stop (squash), preferably half way up, force must be then transferred to the other footpad continuing its full revolution (over the top). As the footpad that is not being squashed begins to rise, force must be transferred to the motionless squashed footpad resting near half way up. The client will then swing downward on that footpad and resume the proper alternating cadence. The result will be a reversal of one of the footpads so the client will have one footpad going forward and one footpad going backward. Even though one footpad is going opposite the rules to the alternating cadence are the same; force is produced on the footpad that is going downward and force is transferred off of the footpad that is rising.

Progression Set 3 (Canters and Tandems)

A. Canter—starting with alternating cadence the user must determine a lead foot and a follow foot. Emphasize the follow foot to speed up/catch up to the lead foot until tandem rhythm has smoothly adjusted into a tandem position, and then move from the tandem position back into an alternating position.

B. Tandem—first and only time force is produced by both sides at the same time, because of this the client must transfer force from heel to toe at the same time on both feet to keep motion in tandem. When the crank is in front of the user, the Toe is weighted on the way down, and the heel is weighted on the way up. The swing motion places both footpads at the top at the same time and both footpads at the bottom at the same time.

Progression Set 4 (Perform the Tandem Progression with Opposing Footpad Motion—one foot forward while other foot simultaneously goes backward on Sets 2 and 3). In this action, the pumping action is the same as in Set 3B, but with the feet moving in opposed directions. In this, as compared to 3B, one footpad is moving forward while the other is moving backwards.

Progression Set 5 (Reverse User Orientation on Set 2, 3, and 4). The person performs the sets as above, except that the direction of the user is reversed. In previous examples, where the crank was in front of the user, the crank will now be positioned behind the user, who has reversed orientation on the system.

Progression Set 6 (Close Eyes on Set 2, 3, 4, and 5). The user will now perform the progressions identified above in sets 2, 3, 4 and 5, but with eyes closed.

Progression Set 7 (Add Force Vector Interference on Set 2, 3, 4, 5, and 6) In this set of progressions, inertia or mass or resistance applied through any part of the body (e.g., as with weights, bands, or pulleys in hand, on arms, on trunk, on legs, etc.) to increase forces needed in performing progressions.

Figure 17C:
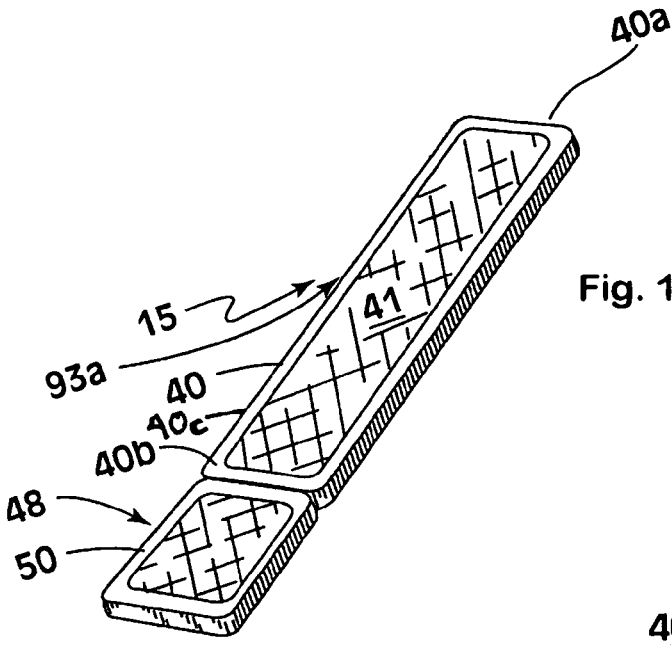
FIG. 17C shows a base position of either one of the two foot tread members of 17C at an intermediate upward position, e.g., less than 15 degrees of arc upward from 17A and lower than the highermost position in 17C.
Figure 17B:
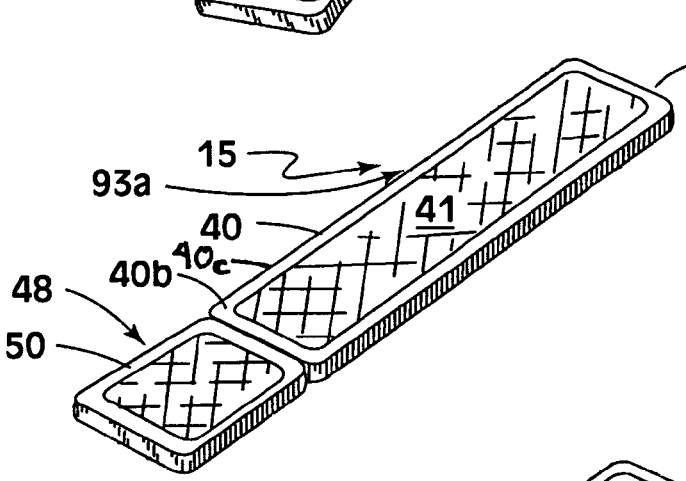
FIG. 17B shows a base position of either one of the two foot tread members of 17C at an intermediate upward position, e.g., less than 15 degrees of arc upward from 17A and lower than the highermost position in 17C.
Figure 17A:
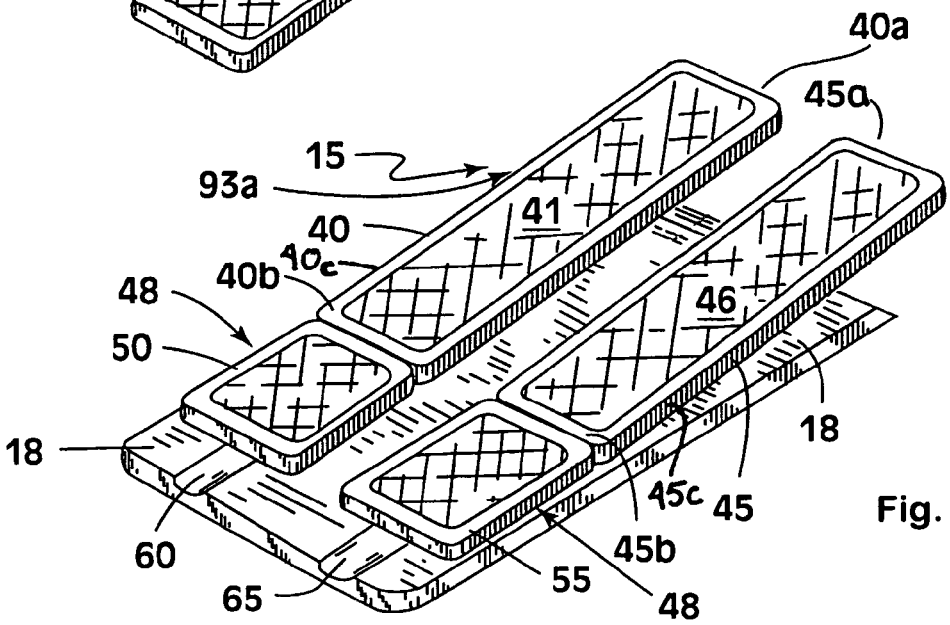
FIG. 17A shows a base position of both foot tread members at a highermost position in 17C.

FIGS. 17A, 17B and 17C show the relative motion between the two foot tread members 40 and 45 as follows.

A method of improving mobility skills of a user on a stationary elliptical exercise device 100 (of FIG. 1), the method comprising a user engaging stationary elliptical device having two foot tread members of footpads (40 and 45), each footpad associated with:

(a) at least one inertial mass (25 and 25*b*) in FIG. 1) providing inertial resistance to rotational movement wherein the inertial mass comprises a plurality of attachable and movable or removeable weights radially disposed about a point of rotation of the inertial mass as previously described herein, the method further comprising performing at least one series of exercises selected from the group consisting of:

i. the user puts at least 95% of body weight on a first foot pad e.g., 45) so that a second footpad (e.g., 40) is free to be manipulated leaving the second footpad 40 as a manipulated footpad resting approximately half way (see FIG. 17B) between a position at top of swing (see FIG. 17C) and bottom of swing positions (see FIG. 17A), the user performing a motion of moving the second footpad 40 and repeatedly leaving the first footpad 45 with less than 15 degrees arc rotation of the manipulated footpad;

ii. the user hops, rapidly shifting weight from one foot to the other foot, from the first footpad 45 that the user is standing on to the second footpad 40 that the user has stabilized in a resting position; and when the user lands on the second resting footpad, the second resting footpad swings down (e.g., to the position of 40 in FIG. 17A), the user then hopping off of the swinging second footpad 40 and when the second footpad 40 stops, the user repeating the motion until repeatedly leaving the swinging footpad with less than 15 degrees arc rotation of the footpad (see FIG. 17B);

iii. the user performing a second motion that swings both footpads at the same time and in the same direction (e.g., in the position of the second foot pad shown in FIG. 17C, both the first footpad 45 and the second footpad 40 would swing the two footpads 40 and 45 approximately half way up on both sides of the swing (similar to the position shown for FIG. 17C which is a greater degree of swing than the degree of swing of FIG. 17B), and when the swing reaches the top on either side, the user will pick the first foot or second foot up at the moment when both footpads reverse direction, leaving the foot pad from which the foot has been removed nearly motionless e.g., when the footpad position in FIG. 17C has a first foot removed, it would remain in that position) while the user swings through the other footpad with the second foot thereon (e.g., the, the user repeating the second motion until repeatedly leaving the swinging footpad with less then 15 degrees arc rotation of the footpad) moving the second footpad between the positions shown in FIGS. 17B and 17A;

iv. the user performing a third motion that swings two footpads 45 and 40 in opposite directions (e.g., from 17C to 17A with one footpad and from 17A to 17C for the other footpad) through a midpoint level (e.g., FIG. 17B), and on an ensuing rise of at least one footpad (e.g., 45 moving from 17A to 17C), the user hops from a first swinging foot pad to a second footpad 40 so that both feet are on the second footpad 40, and so that first swinging footpad 45 stops, and each time the foot pad with both feet on the foot pad that is swinging and begins to rise (e.g., from 17A to 17C), the user transfers force from the foot pad with both feet thereon (e.g., 40) by moving at least one foot from the second footpad 40 to the first foot pad 45 when the second foot pad having both feet thereon 40 stops; the user repeating the third motion until repeatedly leaving the second footpad 40 from which force has been removed with less then 15 degrees arc rotation of the footpad (e.g., 17B) from which force has been removed.

I claim:

1. A method of improving mobility skills of a user on a stationary elliptical exercise device, the method comprising engaging a stationary elliptical exercise device having two footpads that rotate elliptically and independently of each other; each foot pad associated with:

(a) at least one inertial mass providing inertial resistance to rotational movement about a horizontal axis wherein a complete arc rotation around the axis is referred to as a swing, the inertial mass comprises a plurality of removably attachable weights radially disposed about a point of rotation of the inertial mass, the method further comprising performing at least series of exercises selected from the group consisting of:

i. initially putting at least 95% of body weight via a first foot on a first foot pad and initially putting at most the remaining 5% of body weight via a second foot on a second footpad to freely manipulate the second footpad and repeatedly leaving the second footpad resting at either a front portion or a rear portion of the swing approximately half way between a top-most position and a bottom-most position of the swing when the second foot is removed from the second footpad, performing this first motion of moving the second footpad back and forth between the front and rear portions of the swing and repeatedly stepping on and off the second footpad at the front and rear portions of the swing such that the second footpad moves less than 15 degrees arc rotation each time the second foot is removed from the second footpad;

ii. placing the first foot on the first footpad and placing the second foot on the second footpad and hopping rapidly back and forth to shift weight between the first foot and the second foot on their respective footpads such that when either foot lands on its respective footpad during hopping, that footpad swings downwardly and when either foot is removed from its respective footpad during hopping, that foot pad eventually stops moving, performing this second motion of hopping back and forth between the footpads until repeatedly leaving the footpads to move less that 15 degrees arc rotation each time a foot is removed from their respective footpad during hopping;

iii. performing a third motion by swinging both footpads at the same time and in the same direction back and forth, swinging the footpads approximately half way up on both sides of the swing, and when the footpads reach halfway up on either side, the first foot is removed from the first foot pad at the moment when both footpads reverse direction, leaving the first footpad nearly motionless while the second foot swings the second foot pad back and forth once until it returns to a position approximately next to the first foot pad and then the second foot is removed from the second footpad while the first foot swings the first footpad back and forth once until it returns to a position approximately next to the second foot pad, this third motion of alternately swinging one foot pad at a time back and forth is repeated until the foot pads repeatedly move less than 15 degrees arc rotation each time a foot is removed from its corresponding footpad; and iv. performing a fourth motion by swinging the two footpads in opposite directions approximately halfway up on both sides of the swing and when the foot pads are rising, the first foot is quickly moved from the first footpad and joined with the second foot on the second footpad such that the first footpad stops swinging and second foot pad swings either forward or backward once and then halfway up, and when the second footpad is rising back up, the first foot is quickly moved back to the first foot pad to swing the first footpad and then the second foot is quickly moved from the second footpad and joined with the first foot on the first footpad such that the second footpad stops swinging and the first footpad swings either forward or backward once and then halfway up, and when the first footpad is rising back up, the second foot is quickly moved back to the second footpad to swing the second footpad; this fourth motion of moving quickly between the first and second footpads is repeated until the foot pads repeatedly move less than 15 degrees arc rotation each time the feet are completely removed from a footpad.

2. The method of claim 1 wherein the plurality of weights is attached symmetrically about the inertial mass.

3. The method of claim 1 wherein the plurality of weights may be attached eccentrically about the inertial mass.

4. The method of claim 1, wherein each inertial mass comprises a coupling member, that couples a front end of each of a first foot tread member having a first footpad and a second foot tread member having a second foot pad pivotally with at least one inertial mass.

5. The method of claim 1, wherein the stationary elliptical exercise device comprises at least two inertial masses each comprising a coupling member, that couples a front end of each of a first foot tread member or a second foot tread member pivotally with at least one inertial mass, wherein each inertial mass is separately attached to only one of the first foot tread member and the second foot tread member.

6. The method of claim 1 wherein the stationary elliptical exercise device further comprises performing the method on an apparatus having: (a) a housing that surrounds said inertial mass and is connected to a rigid connector member and a leg support.

7. A method of improving mobility skills of a user on a stationary elliptical exercise device comprising two footpads, each footpad associated with:

(a) a frame member having a transverse pivot axis defined relative to the frame member;

(b) a first foot tread member and a second foot tread member, each first and second foot tread member having a front end, a rear end, and two sides, each first and second foot tread member front end operatively associated with a coupling member for pivotally coupling the front end of each first and second foot tread member to the transverse pivot axis at a predetermined distance from the transverse pivot axis, so that each first and second foot tread member front end travels in an arcuate path about the transverse pivot axis such that each footpad travels about the same transverse pivot axis and one complete rotation about the axis is referred to as a swing, a pair of wheel members disposed for rotation about the transverse pivot axis, each coupling member comprising a bell crank, each bell crank disposed so as to rotate with at least one wheel of said pair of wheels, a first end of each bell crank pivotally connected to the front end of a respective one of the first and second foot tread members, each first and second foot tread member moving independently of the other of said first and second foot tread member, each first and second foot tread member moving along a line between the tread member front end and rear end, each first and second foot tread member rear end operatively associated with a glide member for moveable coupling of the rear end of each first and second foot tread member to the frame member, to direct each first and second foot tread member rear end along a reciprocating path of travel as each first and second foot tread member first end travels in an arcuate path;

(c) whereby when the exercise device is in use, and when the rear end of each first and second foot tread member travels along the reciprocating path of travel in a direction away from the pivot axis, the toe portion of the user's foot associated therewith initially lowers at a rate faster than the heel portion of the user's foot, and when the rear end of each first foot tread member and second foot tread member travels along the reciprocating path of travel in a direction toward the pivot axis, the toe portion of the user's foot associated therewith initially rises at a rate faster than the heel portion of the user's foot;

the method comprising performing at least one series of exercises on the stationary elliptical exercise device selected from the group consisting of:

i. initially putting at least 95% of body weight via a first foot on a first foot pad and initially putting at most the remaining 5% of body weight via a second foot on a second footpad to freely manipulate the second footpad and repeatedly leaving the second footpad resting at either a front portion or a rear portion of the swing approximately half way between a top-most position and a bottom-most position of the swing when the second foot is removed from the second footpad, performing this first motion of moving the second footpad back and forth between the front and rear portions of the swing and repeatedly stepping on and off the second footpad at the front and rear portions of the swing such that the second footpad moves less than 15 degrees arc rotation each time the second foot is removed from the second footpad;

ii. placing the first foot on the first footpad and placing the second foot on the second footpad and hopping rapidly back and forth to shift weight between the first foot and the second foot on their respective footpads such that when either foot lands on its respective footpad during hopping, that footpad swings downwardly and when either foot is removed from its respective footpad during hopping, that foot pad eventually stops moving, performing this second motion of hopping back and forth between the footpads until repeatedly leaving the footpads to move less that 15 degrees arc rotation each time a foot is removed from their respective footpad during hopping;

iii. performing a third motion by swinging both footpads at the same time and in the same direction back and forth, swinging the footpads approximately half way up on both sides of the swing, and when the footpads reach halfway up on either side, the first foot is removed from the first foot pad at the moment when both footpads reverse direction, leaving the first footpad nearly motionless while the second foot swings the second foot pad back and forth once until it returns to a position approximately next to the first foot pad and then the second foot is removed from the second footpad while the first foot swings the first footpad back and forth once until it returns to a position approximately next to the second foot pad, this third motion of alternately swinging one foot pad at a time back and forth is repeated until the foot pads repeatedly move less than 15 degrees arc rotation each time a foot is removed from its corresponding footpad; and iv. performing a fourth motion by swinging the two footpads in opposite directions approximately halfway up on both sides of the swing and when the foot pads are rising, the first foot is quickly moved from the first footpad and joined with the second foot on the second footpad such that the first footpad stops swinging and second foot pad swings either forward or backward once and then halfway up, and when the second footpad is rising back up, the first foot is quickly moved back to the first foot pad to swing the first footpad and then the second foot is quickly moved from the second footpad and joined with the first foot on the first footpad such that the second footpad stops swinging and the first footpad swings either forward or backward once and then halfway up, and when the first footpad is rising back up, the second foot is quickly moved back to the second footpad to swing the second footpad; this fourth motion of moving quickly between the first and second footpads is repeated until the foot pads repeatedly move less than 15 degrees arc rotation each time the feet are completely removed from a footpad.

8. The method of claim 7, wherein the frame member includes a linear track for each glide member.

9. The method of claim 7 wherein at least one of the first foot tread member and the second foot tread member comprises a frame with a pad removeably inserted and secured into the frame, the pad having a surface providing friction to a foot of a user of the exercise device, the pad being replaceable within the frame without destruction of the pad or the frame.

* * * * *